US007436123B2

(12) United States Patent
Hamamoto et al.

(10) Patent No.: US 7,436,123 B2
(45) Date of Patent: Oct. 14, 2008

(54) DISCHARGE LAMP BALLAST DEVICE AND LIGHTING APPLIANCE

(75) Inventors: Katsunobu Hamamoto, Neyagawa (JP); Kazuhiro Nishimoto, Kashihara (JP); Masahiro Yamanaka, Otsu (JP); Toshiya Kanja, Uji (JP)

(73) Assignee: Matsushita Electric Works, Ltd., Kadoma-shi (JP)

( * ) Notice: Subject to any disclaimer, the term of this patent is extended or adjusted under 35 U.S.C. 154(b) by 0 days.

(21) Appl. No.: 11/792,073

(22) PCT Filed: Nov. 29, 2005

(86) PCT No.: PCT/JP2005/021832

§ 371 (c)(1),
(2), (4) Date: Jun. 1, 2007

(87) PCT Pub. No.: WO2006/059583

PCT Pub. Date: Jun. 8, 2006

(65) Prior Publication Data

US 2007/0296355 A1 Dec. 27, 2007

(30) Foreign Application Priority Data

| | | |
|---|---|---|
| Dec. 3, 2004 | (JP) | 2004-351528 |
| Dec. 14, 2004 | (JP) | 2004-361615 |
| Dec. 14, 2004 | (JP) | 2004-361992 |
| Jun. 27, 2005 | (JP) | 2005-187262 |
| Sep. 5, 2005 | (JP) | 2005-256837 |

(51) Int. Cl.
*H05B 37/02* (2006.01)

(52) U.S. Cl. ..... 315/219; 315/224; 315/293; 315/299; 315/360

(58) Field of Classification Search ..... 315/209 R, 315/219, 224, 225, 226, 241 R, 242, 291, 315/293, 299, 307, 308, 309, 360, DIG. 7
See application file for complete search history.

(56) References Cited

U.S. PATENT DOCUMENTS 5,170,099 A * 12/1992 Ueoka et al. ..... 315/291

(Continued)

FOREIGN PATENT DOCUMENTS

| | | |
|---|---|---|
| JP | 2003-59681 | 2/2003 |
| JP | 2003-203795 | 7/2003 |

*Primary Examiner*—Thuy Vinh Tran
(74) *Attorney, Agent, or Firm*—Edwards Angell Palmer & Dodge LLP

(57) ABSTRACT

An inverter controller dives an inverter to operate at a switching frequency selectively from one of a preheating frequency (f1), a starting frequency (f2), and a lighting frequency (f3) which are different from each other, thereby giving a preheating mode, a starting mode, and a lighting mode. A reset means is provided to make the starting mode upon lowering of a voltage supplied to the inverter below a first threshold, while an inverter stop means is provided to stop the inverter upon detection of abnormality of a discharge lamp. A timer generates a signal determining the start of the preheating, starting, and/or lighting modes, and generates a reset signal disable signal for disabling the reset means, an inverter stop disable signal for disabling the inverter stop means. The inverter controller includes a frequency sweep means for varying the switching frequency gradually from the starting frequency to the lighting frequency. The timer disables the reset means only during a period starting from the selection of the preheating frequency and ending when the switching frequency varies to the lighting frequency, and disable the inverter stop means only during a period starting from the selection of the preheating frequency and ending when the switching frequency begins to vary from the starting frequency to the lighting frequency.

27 Claims, 12 Drawing Sheets

U.S. PATENT DOCUMENTS 5,295,036 A * 3/1994 Yagi et al. ..... 361/79
6,127,788 A * 10/2000 Yamamoto et al. ..... 315/307
6,515,431 B2 * 2/2003 Moo et al. ..... 315/224
6,949,885 B2 * 9/2005 Hamamoto et al. ..... 315/200 R

* cited by examiner

DISCHARGE LAMP BALLAST DEVICE AND LIGHTING APPLIANCE

This application is a National Phase application filed under 35 U.S.C. 371 claiming the benefit of PCT/JP05/21832 filed on Nov. 29, 2005, which has priority based on Japan applications 2004-351528 filed on Dec. 3, 2004, 2004-361615 filed on Dec. 14, 2004, 2004-361992 filed on Dec. 14, 2004, 2005-187262 filed on Jun. 27, 2005, and 2005-256837 filed on Sep.5, 2005.

TECHNICAL FIELD

The present invention is directed to a discharge lamp ballast and a lighting appliance equipped with the discharge lamp ballast device.

BACKGROUND ART

As disclosed in Japanese Patent Publication No, 2003-203795, a discharge lamp ballast for a discharge lamp, especially for a fluorescent lamp of hot-cathode type is configured to provide a preheating mode for preheating filaments, a starting mode for applying a high voltage after the preheating mode to start the lamp, and thereafter a lighting mode for rated lighting or dimmed lighting of the lamp. The duration of the individual modes is given by use of a timer. The discharge lamp ballast device includes a chopper for boosting a DC power give by rectification of an AC power from an AC power source, an inverter for converting the DC power output from the chopper into an AC power, and a resonance circuit which resonates the high frequency AC power output from the inverter to apply the same to the discharge lamp. The inverter includes a switching element of which switching frequency is varied so as to apply different voltages to the discharge lamp respectively during the preheating mode, the starting mode, and the lighting mode.

The discharge lamp ballast device is provided with a reset means which is configured to detect the output voltage from the chopper to the inverter in order to reset the inverter back to the preheating mode when the DC output voltage to the inverter is lowered due to an instantaneous power failure of the AC power source, thereby protecting the discharge lamp as well as circuit components of the inverter from undue stress.

Also, the discharge lamp ballast device is configured to stop the inverter upon detection of a lamp abnormality such as a no-load or a lamp life-end condition, for protecting the circuit components from undue stress.

Further, in order to avoid the inverter from being reset to the preheating mode or the starting mode immediately after the lamp start in case the output voltage from the chopper to the inverter is instantaneously lowered due to ripple voltage in the output of the chopper, the discharge lamp ballast device is configured to disable the reset means during the preheating mode and the starting mode, prohibiting the preheating mode even upon lowering of the output voltage to the inverter.

However, when the discharge lamp comes to its near lamp-life end, it is likely that the high lamp voltage results in an excessive load power which lowers the output voltage from the chopper to the inverter. With this consequence, the reset means operates immediately after the lamp start to resume the preheating mode or starting mode, and therefore repeat the preheating mode and the starting mode, thereby giving an excessive stress to the circuit components, and even resulting in a failure of the discharge lamp ballast device. Especially, when there is a great difference in the switching frequency between the starting mode and the lighting mode so that the inverter output varies to a large extent (for example, in a dimming of the lamp), the output voltage from the chopper to the inverter may be lowered instantaneously, which triggers the reset means during this transition period.

DISCLOSURE OF THE INVENTION

In view of the above problem, the present invention ahs been achieved to provide a discharge lamp ballast device which is capable of assuring a stable lighting operation free from being reset even upon instantaneous lowering of an input voltage to the inverter immediately after the lamp start, and therefore free from undue stress on the circuit components.

The discharge lamp ballast device in accordance with the present invention includes a rectifier configured to rectify an AC voltage from an AC power supply, a chopper, an inverter, a resonance circuit, and an inverter controller. The chopper includes an inductor, a smoothing capacitor, and a switching element to convert the output voltage of the rectifier into a DC voltage. The inverter includes at least one switching element which is turned on and off at a high frequency to convert the chopper output into an AC power. The resonance circuit includes at least one inductance element and a capacitor to resonate the AC power output from the inverter to apply the same to the discharge lamp. The inverter controller is configured to drive said at least one switching element selectively at one of a preheating frequency (f1), a starting frequency (f2), and lighting frequency (f3) which are different from each other, so as to give a preheating mode in which the inverter provides a preheating voltage for preheating filaments of the discharge lamp, a starting mode in which the inverter provides a starting voltage for staring the discharge lamp, and a lighting mode in which the inverter provides a lighting voltage for stably lighting the discharge lamp. The discharge lamp ballast device further includes a lamp abnormality detection circuit, a reset means, an inverter stop means, and a timer. The reset means is configured to detect a chopper output voltage from the chopper to the inverter and to operate the starting mode or preheating mode when the chopper output voltage is lowered below a first threshold. The inverter stop means is configured to operate the inverter controller to stop the inverter when the lamp abnormality detection circuit detects the abnormality. The timer is configured to provide to a signal determining the start of the preheating mode, the starting mode, and the lighting mode, and to generate a reset disable signal disabling the reset means and an inverter stop disable signal disabling the inverter stop means, respectively;

The discharge lamp ballast device of the present invention is characterized by that the inverter controller includes a frequency sweep means which varies the switching frequency gradually from the starting frequency to the lighting frequency, and that the timer is configured to generate the reset disable signal only during a period starting upon selection of the preheating frequency and ending at a time when the switching frequency is caused by the frequency sweep means to reach the lighting frequency for disabling the reset mans during this period, and to generate the inverter stop disable signal only during a period starting upon selection of the preheating frequency and ending at a time when the switching frequency is caused by the frequency sweep means to begin varying from the starting frequency to the lighting frequency, thereby disabling the inverter stop means during this period.

Accordingly, the reset means is invalidated until the lamp proceeds to the lighting mode after the lamp start. Whereby, even if the output voltage from the chopper to the inverter is instantaneously lowered, the lamp can proceed to the lighting mode without returning to the starting mode or the preheating mode, thereby protecting the circuit components from undue stress. Further, since the inverter stop means is enabled before the expiration of the period in which the reset means is kept disabled, the inverter can be immediately stopped when the lamp abnormality is detected just after the lamp start for protection of the inverter circuit. Particularly, since the frequency sweep means is used to give a transition period during which the switching frequency varies gradually from the starting frequency to the lighting frequency, it is possible to restrain the variation of the chopper output being fed to the inverter during this transition period, thereby assuring a stable transition from the starting mode to the lighting mode.

The discharge lamp ballast device is preferred to include a feedback means which is configured to detect a current flowing through at least one switching element of the inverter, and to control the inverter controller to keep the current at a predetermined value. In this instance, the timer is configured to disable the feedback means only during a period starting upon selection of the preheating frequency and ending at a time when said switching frequency is caused by said frequency sweep means to begin varying towards said lighting frequency, i.e., until proceeding to the transition period. Thus, the feedback means 400 is allowed to operate only after the lamp is started and the current flowing through the discharge lamp becomes stable, assuring to make the feedback control in a stable manner.

Also, the discharge lamp ballast device is preferred to include a preheating circuit supplying a preheating current to the filaments of the discharge lamp, and a preheating controller which controls the preheating circuit to regulate the preheating current. The preheating controller is configured to, in response to a signal from the timer, control the preheating circuit to supply the preheating current during a period ranging from the preheating mode to the end of the starting mode, and to restrain the preheating current after the end of the starting mode, for providing a suitable preheating current to the discharge lamp.

The lamp abnormality detection circuit is configured to detect a physical amount indicative of a condition of the discharge lamp, while the inverter stop means is configured to include a signal generation circuit which provides a stop signal when the physical amount exceeds a predetermined reference so that the inverter controller stops the output of the inverter in response to the stop signal. The signal generation circuit is configured to define the reference by a first lamp threshold or a second lamp threshold greater than the first lamp threshold, and to select the second lamp threshold during the transition period (t3–t4) during which the switching frequency varies from the starting frequency to the lighting frequency, and otherwise select the first lamp threshold. Even if the output voltage from the chopper to the inverter is instantaneously lowered during this transition period, the lamp is kept turned on since the reset means is disabled, but the lamp voltage might instantaneously rise above the first lamp threshold due to the lowering of the output current from the inverter. However, since the second lamp threshold higher than the first lamp threshold is relied upon in the transition period for detection of the lamp abnormality, the inverter can be protected from being accidentally stopped in response to a false abnormality detection.

The inverter stop means is preferred to detect the lamp abnormality based upon a peak value of the voltage across the discharge lamp, and a DC component in that voltage. In this instance, the lamp abnormality detection circuit is configured to include a peak detection circuit for detection of the peak value of the voltage across the discharge lamp, and a DC component detection circuit for detection of the DC component included in the lamp voltage across the discharge lamp. The inverter stop means comprises a first signal generation circuit generating a first stop signal when the peak value exceeds a predetermined threshold, and a second signal generation circuit generating a second stop signal when the DC component exceeds a predetermined threshold, so as to provide the stop signal to the inverter controller for lowering the output of the inverter upon receiving any one of the first and second stop signals. At least one of the first and second signal generation circuits has a first threshold and a second threshold greater than the first threshold, and selects the second threshold during the transition period (t3 to t4) where the switching frequency varies from said starting frequency to the lighting frequency, and otherwise selects the first threshold. With this arrangement, the lamp abnormality can be accurately judged by use of the peak value of the lamp voltage and its DC component, avoiding false detection of lamp abnormality during the transition period.

It is also preferred that the inverter controller, the reset means and the inverter stop means are realized in a single integrated circuit. In this instance, the inverter controller is equipped with frequency setting section which gives the switching frequency each corresponding to one the individual modes in response to the output signal from the timer, whereas the frequency sweep means is configured to sweep the frequency given at the frequency setting section in accordance with a varying charged or discharged voltage across a capacitor externally connected to the integrated circuit.

Further, the timer includes a circuit for charging and discharging the capacitor externally connected to the integrated circuit so as to determine the end of the preheating mode as well as the starting mode based upon the charged voltage of the capacitor such that the frequency setting section of the frequency sweep means sweeps the frequency in accordance with the variation of the voltage across the capacitor for determining the start of the individual modes. Thus, the capacitor is shared by the timer and the frequency sweep means for reducing a number of components externally connected to the integrated circuit.

In addition, the frequency sweep means is preferred to include a sweep signal generation circuit which provides a DC voltage rising or lowering immediately after the end of the starting mode according to the output signal of the timer such that the frequency setting section varies the switching frequency in accordance with the varying DC voltage. In this instance, the sweep signal generation circuit is configured to provide a first trigger signal enabling and disabling the reset means, and a second trigger signal enabling and disabling the inverter stop means.

Further, the inverter controller is preferably configured to vary the high frequency output from the inverter in accordance with an external demand of a dimming ratio. In this instance, the frequency sweep means is configured to vary a sweep duration based upon the dimming ratio.

In a preferred embodiment, the frequency sweep means of the inverter controller is configured to provide a sweep voltage varying gradually during the transition period from the end of the starting period to the start of the lighting period. The inverter controller includes a first current generation circuit providing a first output current in proportion to the sweep voltage, a second current generation circuit providing a second output current of a constant level, a drive signal generation circuit which is equipped with a capacitor being charged and discharged by the first and second output currents to determine the switching frequency based upon a charging-and-discharging rate of the capacitor, and a switching circuit which actuates the first and second current generation circuits selectively or simultaneously. The switching circuit is controlled by said timer to actuate the first current generation circuit and the second current generation circuit during the preheating mode for determining the preheating frequency based upon the sum of the first current and the second current, to actuate only the first current generation circuit during the starting mode for determining the starting frequency based upon the first current, to actuate only the first current generation circuit during the transition period for varying the switching frequency gradually to the lighting frequency in accordance with the sweep voltage, and to actuate only the second current generation circuit for determining the switching frequency based upon the second current. In this manner, the two independent first and second generation circuits are utilized to determine the preheating frequency, the starting frequency, and the lighting frequency, based upon the first current, the second current, and the sum of the first and second currents, which permits to give a precise frequency setting rather than relying upon a varying current from a single current generation circuit.

Further, the present invention may include pulsating voltage detection circuit which detects the output voltage from the rectifier to the chopper and provides a signal to the inverter controller upon lowering of the output voltage for stopping the inverter. The pulsating voltage detection circuit includes a comparator which compares a pulsating DC voltage output from the rectifier to the chopper with a predetermined voltage, a capacitor which is charged and discharged depending upon an output of the comparator; a constant current circuit configured to charge and discharge the capacitor at a constant current; and a discriminator configured to compare the voltage across the capacitor with a predetermined reference. The constant current circuit is configured to charge the capacitor at the constant current from the constant current circuit when receiving from the comparator an output indicative of that the pulsating DC voltage exceeds the predetermined voltage, and otherwise discharge the capacitor to provide the constant current from the capacitor to the constant current circuit. The discriminator is configured to provide to the inverter controller an enable signal of enabling the inverter to operate, and otherwise provide a disable signal to the inverter controller for stopping the operation of the inverter. Such pulsating voltage detection circuit can be realized by use of a relatively simple circuit configuration, assuring a discharge lamp ballast device capable of being optimally integrated.

The above and other advantageous features and objects will be comprehended from the following description taken in conjunction with the drawings.

BEST MODE FOR CARRYING OUT THE INVENTION

First Embodiment

Figure 1:
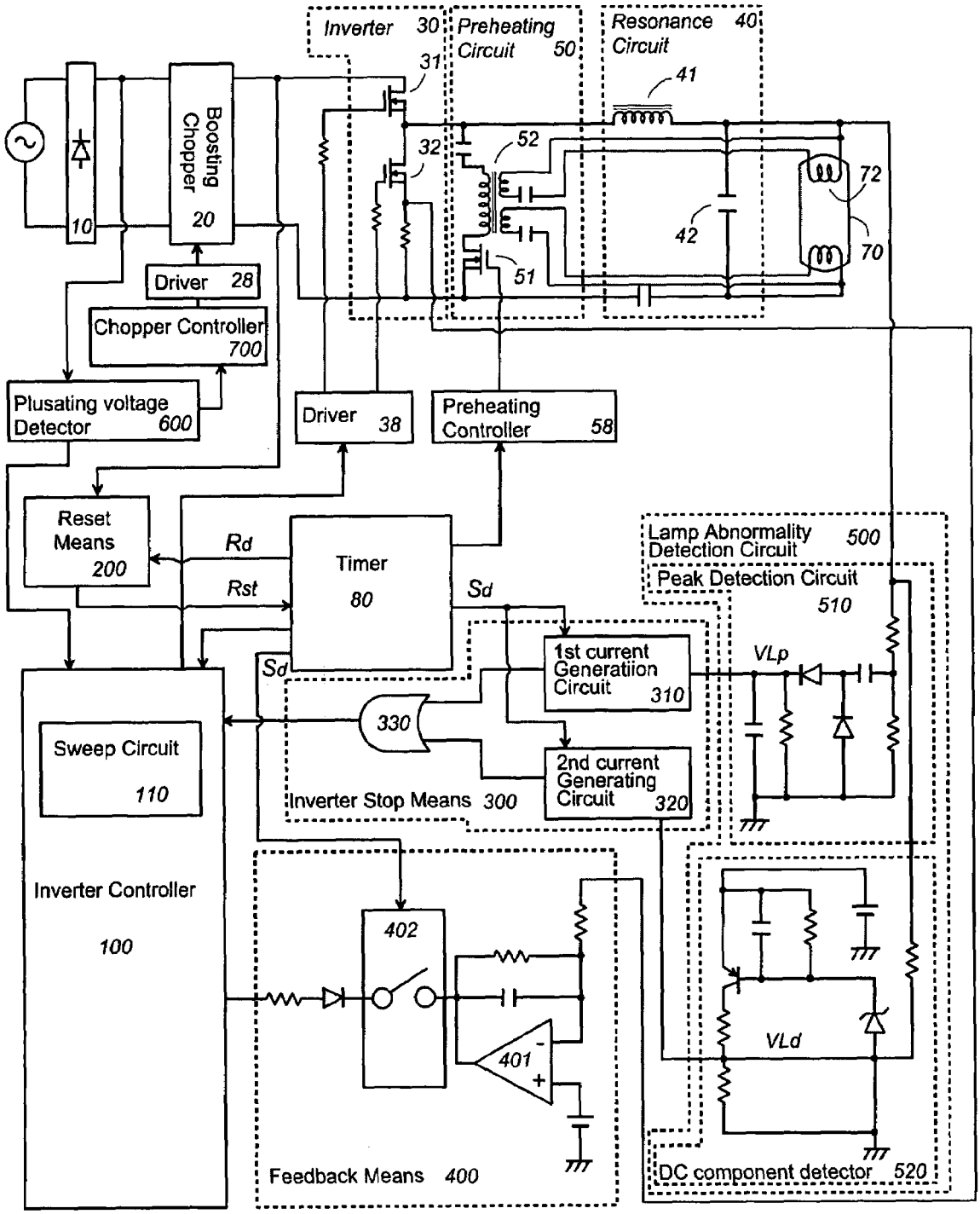
FIG. 1 is a block circuit diagram illustrating a discharge lamp ballast device in accordance with a first embodiment of the present invention.

FIGS. 1 to 5 illustrate a discharge lamp ballast device in accordance with a first embodiment of the present invention. The discharge lamp ballast device is incorporated in an appliance mounting a discharge lamp, and includes a rectifier 10 rectifying an AC voltage from an AC power source, a chopper 20 receiving a pulsating DC voltage from the rectifier 10 to generate a boosted DC voltage, an inverter 30 converting the boosted DC voltage into a high frequency AC voltage, and a resonance circuit 40 resonating the high frequency AC voltage so that the resonating voltage from the resonant circuit is applied to the discharge lamp 70 for lighting the same. Further, the discharge lamp ballast device is equipped with a preheating circuit 50 which supplies a preheating current to filaments of the discharge lamp 70.

The chopper 20 includes a switching element which is turned on and off in accordance with a control signal from a chopper controller 700 to boost the pulsating DC voltage from the rectifier 10 and supply a boosted and smoothed DC voltage to the inverter 30. The inverter 30 includes switching elements 31 and 32 which are connected in series across the output end of the chopper, and are alternatively turned on and off to supply a high frequency voltage to the resonance circuit. The resonance circuit 40 includes an inductor 41 and a capacitor 42 which are connected in series across the one switching element 32. The switching elements 31 and 32 are driven to turn on and off at different frequencies around a resonant frequency of the resonance circuit to provide a preheating mode of supplying the preheating current to the discharge lamp 70, a starting mode of igniting the discharge lamp, and a lighting mode of stably lighting the discharge lamp. In the starting mode, the switching frequency is set to be closest value (starting frequency=f2) as a high starting voltage is required to ignite the discharge lamp. In the preheating mode, the switching frequency is set to be a preheating frequency (f1) shifted from and slightly higher than the starting frequency (f2) in order to give a sufficient amount of the preheating current to the non-ignited discharge lamp. In the lighting mode, the switching frequency is set to be a lighting frequency (f3) shifted from and lower than the starting frequency to give a relation f1>f2>f3.

Figure 2:
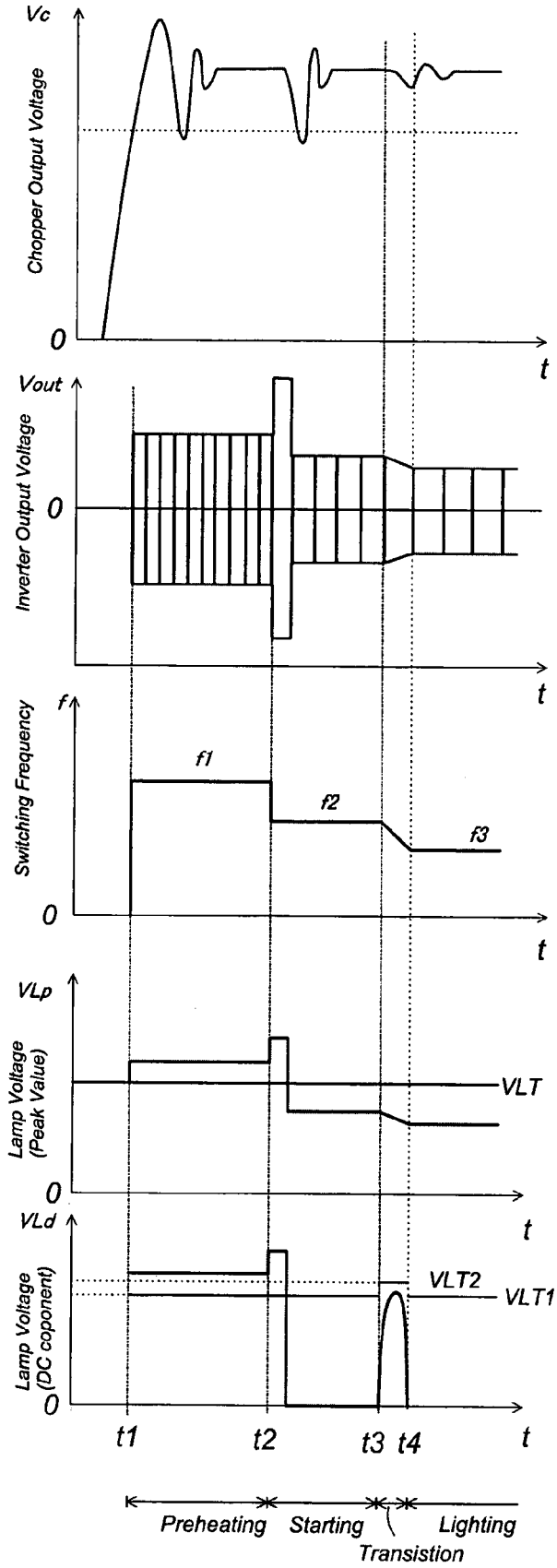
FIG. 2 is a waveform chart illustrating the operation of the above discharge lamp ballast device.

The inverter controller 100 provides a frequency signal which determines the preheating frequency (f1), the starting frequency (f2), and the lighting frequency (f3), and is given to a driver 38. The driver operates to turn on and off the switching elements 31 and 32 at the switching frequency determined by the frequency signal. The inverter controller 100 includes a sweep circuit 110 which varies the switching frequency from the starting frequency (f2) to the lighting frequency (f3), and drives, as shown in FIG. 2, the switching elements 31 and 32 at the individual switching frequencies during the preheating period (t1 to t2), the starting period (t2 to t3), a sweep period (t3 to t4), and the lighting period (t4−) respectively defined by an output from a timer 80, thereby applying a preheating voltage, a starting voltage, a sweep voltage, and a lighting voltage through the resonance circuit 40 to the discharge lamp 70.

During the preheating period (t1 to t2) and the starting period (t2 to t3), a preheating controller 58 turns on a switching element 51 of the preheating circuit 50 in accordance with a signal from the timer 80 to derive the preheating current from the output voltage of the inverter 30 through a transformer 52, and supplies it to the filaments 72. In the other period, the switching element 51 is kept turned off.

The discharge lamp ballast device includes a feedback means 400 for keeping a constant lamp current flowing through the lamp after the lamp start. The feedback means 400 is configured to regulate the switching frequency of the inverter 30 to keep the current flowing through the switching element 32 of the inverter at a level in proportion to the lamp current. A comparator 401 compares the current with a predetermined value to give an output to the inverter controller 100 which responds to regulate the switching frequency.

The discharge lamp ballast device further includes a reset means 200 which reset the inverter 30 back to the preheating mode when the output voltage Vc from the chopper 20 to the inverter 30 is lowered below a predetermined threshold, and an inverter stop means 300 which stops the inverter 30 when the discharge lamp is detected to come near lamp life-end.

The reset means 200 is configured to provide a reset signal Rst to the timer 80 when the output of the chopper 20 is lowered below the predetermined threshold. In response to the reset signal Rst, the timer 80 provides a signal to the inverter controller 100 to operate the inverter 30 in the starting mode. Although the present embodiment illustrates that the reset signal causes the inverter to return to the starting mode, the reset signal may be utilized to reset the inverter back to the preheating mode.

The inverter stop means 300 provides a stop signal to the inverter controller 100 for stopping the inverter upon receiving a signal indicative of a life-end of the discharge lamp from a lamp abnormality detection circuit 500. The lamp abnormality detection circuit 500 includes a peak detection circuit 510 for detecting a peak value VLp of a voltage across the discharge lamp 70, i.e. a lamp voltage, and a DC component detection circuit 520 for detecting a DC component included in the lamp voltage. The inverter stop means 300 includes a first signal generation circuit 310 providing the stop signal when the peak value of the lamp voltage exceeds a predetermined lamp threshold, and a second signal generation circuit 320 providing the stop signal when the DC component exceeds a predetermined lamp threshold. The circuits 310 and 320 are connected through an OR gate 330 to the inverter controller 100 which stops the inverter upon receiving the stop signal from either of the circuits. The stop of the inverter is meant to stop the discharge lamp, and to include a case where the inverter output does not become completely zero.

As shown in FIG. 2, the present embodiment utilizes a constant lamp threshold VLT for comparison with the peak value, and a first lamp threshold VLT1 and a second lamp threshold VLT2 higher than the first lamp threshold (VLT1<VLT2) for comparison with the DC component. The second signal generation circuit 320 utilizes the second lamp threshold VLT2 only during the transition period (t3 to t4), and otherwise utilizes the first lamp threshold VLT1. During the transition period (t3 to t4), even if the output voltage from the chopper 20 to the inverter 30 lowers instantaneously, the lamp is kept turned on since the reset means is kept disabled. Nevertheless, It is possible that, in consequence of the reduction of the current from the inverter 30, the lamp voltage rises to instantaneously exceed the first lamp threshold VLt1. However, since the second signal generation circuit 320 utilizes the second lamp threshold VLT2 higher than the first lamp threshold VLT1 in the transition period (t3 to t4), a false lamp abnormality detection is avoided to prevent the inverter from being accidentally stopped. In this connection, the two different lamp thresholds may be applied to the first signal generation circuit 310 in order to avoid an accidental stop of the inverter 30 when the DC component of the lamp voltage rises instantaneously due to the instantaneous lowering of the chopper output during the transition period (t3 to t4). Accordingly, the two lamp thresholds are applied at least to one of the first and second signal generation circuits 310 and 320 to ensure a stable operation.

The reset means 200 is kept disabled by an output RD from the timer 80 over a duration (t1 to t4) ranging from the preheating period to the transition period, while the inverter stop means 300 and the feedback means 400 is disabled by a disable signal Sd from the timer 80 over a duration (t1 to t4) ranging from the preheating period to the starting period. In short, the reset means 200 is enabled after the end of the transition period (t3 to t4), and the inverter stop means 300 and feedback means 400 becomes enabled in the transition period (t3 to t4). Consequently, as shown in FIG. 2, when the discharge lamp is turned on in the starting period and is subsequently detected to come near its life-end in the transition period (t3 to t4), the inverter 30 is immediately stopped to avoid undue stress from being applied to circuit components constituting the inverter. During the transition period (t3 to t4), the switching frequency is caused to vary gradually from the staring frequency (f2) to the lighting frequency (f3) to avoid large variation in the chopper output Vc. Even when the chopper voltage Vc varies instantaneously due to an unstable condition of the lamp immediately after the lamp start, the reset means 200 is disabled in this transition period to permit the lamp to advance immediately to the lighting mode without being reset to the preheating mode. After passing through the transition period and entering the lighting period (t4−), the reset means becomes enabled so that, when the lamp is extinguished with associated lowering of the chopper output below the threshold, the inverter 30 is reset to the starting mode for restarting the lamp. The feedback means 400 is actuated by the signal from the timer 80 to turn on and off a switch 402 to be kept disabled over a duration (t1 to t3) ranging from the preheating period to the starting period, and is otherwise enabled.

Figure 3:
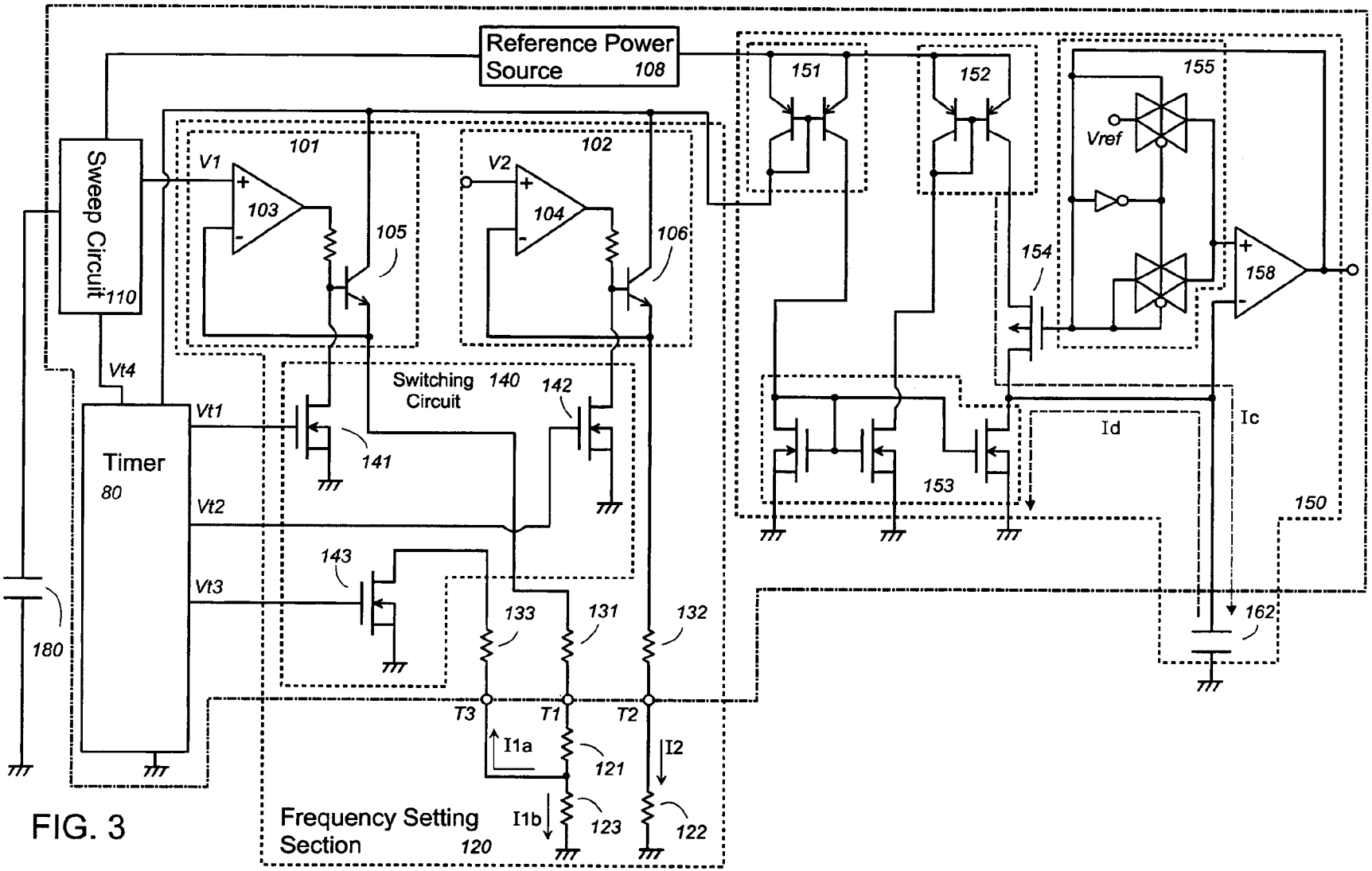
FIG. 3 is a circuit diagram of an inverter controller utilized in the above discharge lamp ballast device.

As shown in FIG. 3, the inverter controller 100 includes the sweep circuit 110 generating a continuously lowering DC voltage, a first current generation circuit 101 energized by the DC output voltage V1 from the sweep circuit 100, and a second current generation circuit 102 with a current source of fixed voltage V2, a switching circuit 140, and a drive signal generation circuit 150. The timer 80 provides, based upon its internal clock signal, signals Vt1, Vt2, and Vt3 indicating a start timing (t1) of the preheating period, a start timing (t2) of the starting period, and a start timing (t3) of the lighting period, and controls the switching circuit 140 and the sweep circuit 110 according to these signals to generate the frequency signal as mentioned in the above. The drive signal generation circuit 150 includes current mirrors 151, 152, and 153 coupled to a reference power source 108, a capacitor 162, a charging switch 154 for charging the capacitor 162 by a current flowing through the current mirror 152, a switch circuit 155 for switching a reference voltage Vref, and a comparator 158 for comparing a voltage of the capacitor 162 with the reference voltage. One FET constituting the current mirror 153 is provided in discharging path of the capacitor 162 so that the comparator 158 outputs a pulse voltage in accordance with the charging and discharging of the capacitor 162. The pulse voltage gives the frequency signal which is fed to the driver 38 for determining the switching frequency of the inverter, i.e. the preheating frequency (f1), the starting frequency (f2), and the lighting frequency (f3).

The first current generation circuit 101, the second current generation circuit 102, the switching circuit 140, the drive signal generation circuit, and the sweep circuit 110 constituting the inverter controller 100 are integrated together with the timer into a single chip integrated circuit to which the capacitor 162, resistors 121, 122, and 123 are externally connected.

Levels of the charge current Ic charging the capacitor 162 through the current mirror 152 and the resulting discharge current Id are determined by the currents flowing from the first current generation circuit 101 and/or the second current generation circuit 102, as discussed hereinafter.

The first current generation circuit 101 includes an operational amplifier 103 providing a current in accordance with the DC voltage V1 output from the sweep circuit 110, and a transistor 105 to establish a first current path for a first current flowing though the external resistors 121 and 123, and a series connected internal resistor 131. The second current generation circuit 102 includes an operational amplifier 102 for flowing a constant current proportional to the fixed voltage V2, and a transistor 106 to establish a second current flow path for a second current flowing through the external resistor 122 and a series connected internal resistor 132.

The switching circuit 140 includes switching elements 141, 142, and 143 which are controlled by the timer 80 to turn on and off. The first switching element 141 is connected across a base-emitter junction of the transistor 105 to allow the first current to flow in the first current only when it is turned off by a signal Vt1 from the timer 80. Similarly, the second switching element 142 is connected across a base-emitter junction of the transistor 106 to allow the second current to flow in the second current path only when it is turned off by a signal Vt2 from the timer 80. The third switching element 143 is inserted in a shut path diverging from the first current path so as to flow the first current in the shunt path through the internal resistor 131, the external resistor 121 and the internal resistor 133 when it is turned on by a signal Vt3 from the timer 80, and to flow the first current in the first current path through the internal resistor 131 and the external resistors 121 and 123 when it is turned off. In the present embodiment, the current value defining the preheating frequency (f1) is set to be the sum of the first current flowing through the shunt path of the first current path and the second current flowing through the second current path, while the current value defining the starting frequency (f2) is set to be the sum of the first current flowing through the first current path and the second current flowing through the second current path, and the current value defining the lighting frequency (f3) is only based upon the second current.

Figure 4:
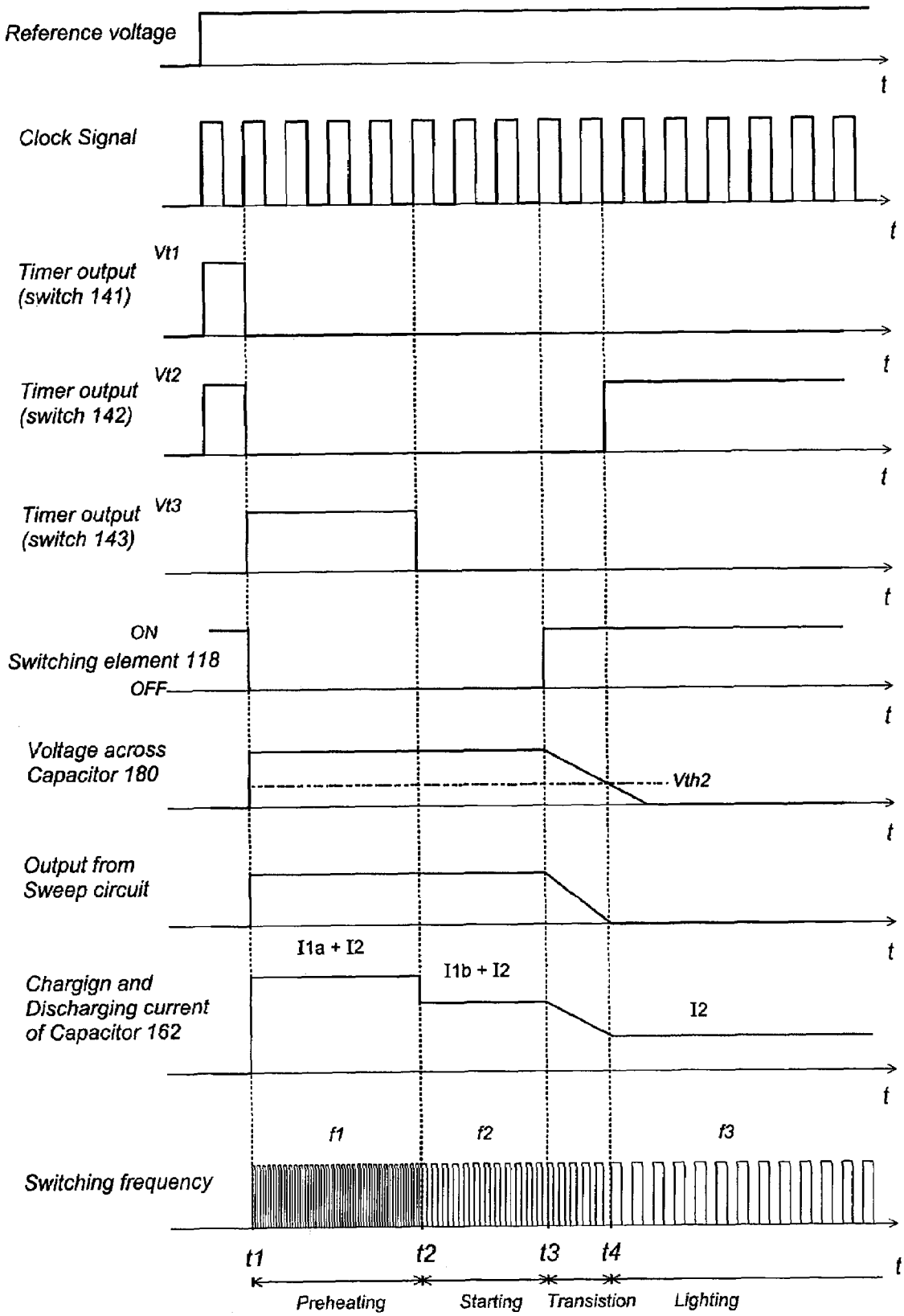
FIG. 4 is a waveform chart illustrating the operation of the above discharge lamp ballast device.

As shown in FIG. 4, during the preheating period (t1 to t2), the first and second switching elements 141 and 142 of the switching circuit 140 are both turned off by the signal output Vt1 and Vt2 from the timer 80, while the third switching element 143 is turned on by the signal output Vt3, flowing the first current I1*a* from the first current generation circuit 101 through resistors 131, 121, 133, and the third switching element 143, and at the same time flowing the second current 102 from the second current generation circuit 102 through resistors 132 and 122. Whereby, the composite current (I1*a*+I2) flows through the current mirrors to charge and discharge the capacitor 162 at a rapid cycle, causing the comparator 158 to provide the frequency signal designating the preheating frequency (f1) of a higher frequency.

During the starting period (t2 to t3), the first and second switching elements 141 and 142 of the switching circuit 140 are both kept turned off by signal output Vt1 and Vt2 from the timer 80, while the third switching element 143 is turned off by the signal output Vt3, flowing the first current I1*b* from the first current generation circuit 101 through resistors 131, 121, and 123, and at the same time flowing the second current I2 from the second current generation circuit 102 through resistors 132 and 122. Whereby, the composite current (I1*b*+I2) flows through the current mirrors to charge and discharge the capacitor 162, causing the comparator 158 to provide the frequency signal designating the starting frequency (f2).

During the transition period (t3 to t4), the composite current (I1*b*+I2) flows as seen during the starting period. But, the current generated by the first current generation circuit 101 gradually lowers in accordance with the output from the sweep circuit 100 with the attendant lowering of the first current I1*b*, thereby decreasing the current for charging and discharging the capacitor 162 so that the comparator 158 provides the frequency signal which decreases the switching frequency gradually from f2 to f3.

During the lighting period (t4−), the first and third switching elements 141 and 143 are turned off, while the second switching element 142 is only turned on to flow the second current I2 from the second current generation circuit 102 through resistors 132 and 122 for charging and discharging the capacitor 162. Whereby, the comparator 158 provides the frequency signal designating the lighting frequency (f3).

In this manner, since the two current generation circuits 101 and 102 are utilized to determine the preheating frequency (f1), the starting frequency (f2), and the lighting frequency (f3) based upon one of the first current and the second current respectively provided by the individual circuits, and the composite current thereof, these frequencies can be set as being distinct from each other. Further, the continuously varying frequency during the transition period (t3 to t4) can be easily obtained by the input DC voltage to the first current generation circuit 101.

Further, the present embodiment gives a configuration where the integrated circuit has its terminal T3 connected to a point between the external resistors 121 and 123 which are connected in series between a terminal T1 and the ground so that a series circuit of the one external resistor 123 and the internal resistor 133 constitutes the shunt path in parallel with the external resistor 121. The switching between the preheating frequency (f1) and the starting frequency (f2) is made by flowing the first current selectively in one of the shunt path and the path parallel thereto. Thus, it is possible to set the optimum frequency with a reduced number of the external resistors. The resistor 122 in the second current path is connected between a terminal T2 of the integrated circuit and the ground.

Figure 5:
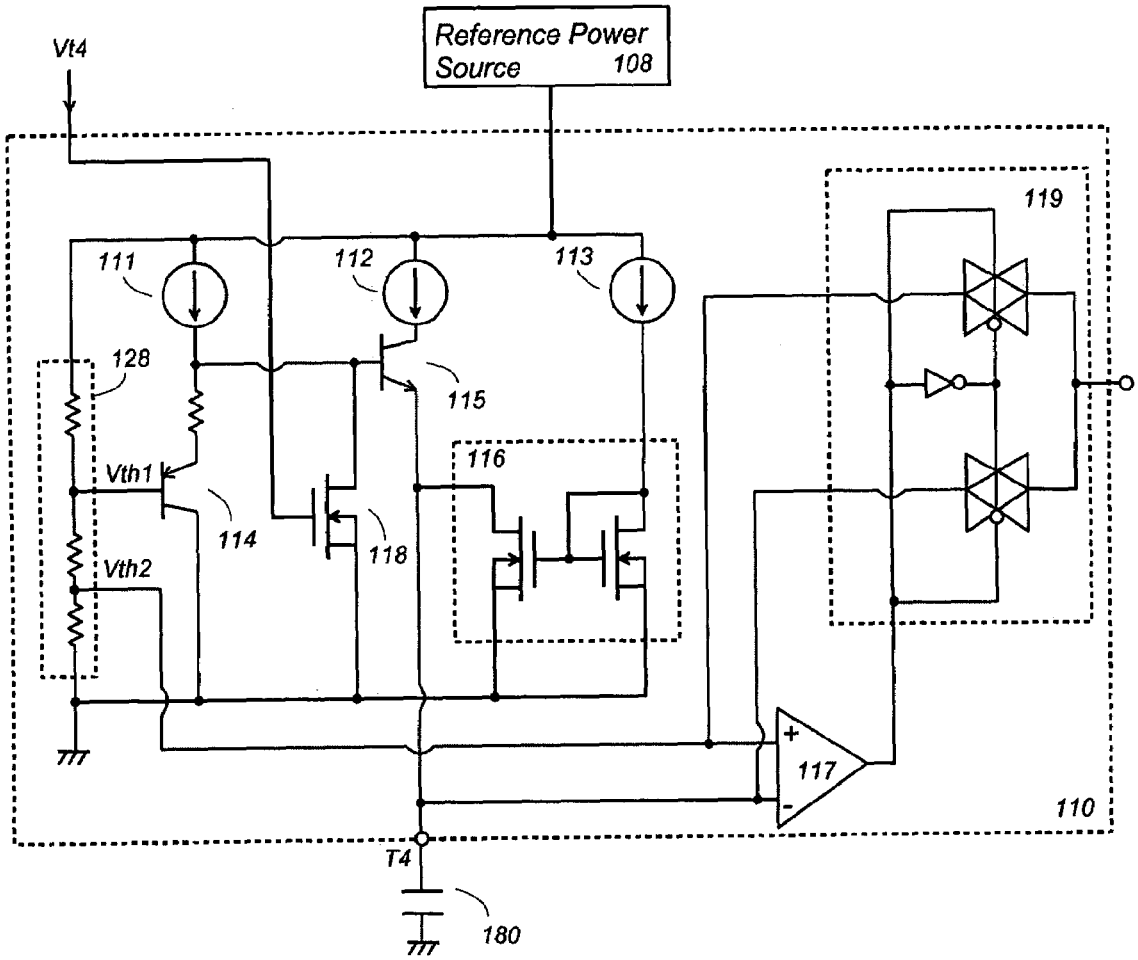
FIG. 5 is circuit diagram of a frequency sweep circuit utilized in the above discharge lamp ballast device.

As shown in FIG. 5, the sweep circuit 110 includes three constant current sources 111, 112, 113, two transistors 114 and 115, a mirror circuit 116, a comparator 117, a switching element 118, a transfer gate 119, and a voltage-dividing resistor network 128. The voltage-dividing resistor network 128 divides a voltage from the reference power source to give threshold voltages Vth1 and Vth2 different from each other (Vth2<Vth2). The threshold voltage Vth1 is input to a base of pnp-type transistor 114, while the other threshold voltage Vth2 is input to a non-inverting input terminal of the comparator 117. The emitter of the transistor 114 is connected through a resistor to the base of the npn-type transistor 115 and also to the constant current source 111 with an emitter voltage of transistor 115 being roughly equal to the threshold voltage Vth1 applied to the base of transistor 114. The transistor 115 has its emitter connected through a terminal T4 to an external capacitor 180, while the comparator 117 has its inverting input is connected to the mirror circuit 116 so that the capacitor 180 is charged up to a voltage roughly equal to the threshold voltage Vth1. The comparator 117 compares the voltage across the capacitor 180 with the threshold voltage Vth2 to provide a L-level signal to the transfer gate 119 when the voltage across the capacitor 180 exceeds the threshold voltage Vth2, and otherwise provide a H-level signal. The switching element 118 is connected between the base of transistor 115 and the ground to be driven by an output signal Vt4 from the timer 80 to turn on and off. When the switching element 118 is off, the capacitor 180 is charged through the transistor 115. When the switching transistor 118 is off, the voltage across the capacitor 180 becomes nearly zero [0 V].

As shown in FIG. 4, the switching transistor 118 is kept turned off by the output signal Vt4 from the timer 80 only through a duration (t1 to t3) ranging from the preheating period to the starting period, during which the capacitor 180 is charged to give the voltage exceeding the threshold voltage Vth2 so that the comparator 117 gives the L-level output. With this result, transfer gate 119 provides a fixed voltage roughly equal to the voltage across the capacitor 180 to the frequency setting section 120. At a time (t3) of ending the starting period, the switching element 118 is turned on to thereby turn off transistor 115, discharging the capacitor 180 by a constant current determined by the mirror circuit 116 so that the voltage across the capacitor 180 is lowered at a uniform gradient. With this consequence, the output voltage from the sweep circuit 110 is lowered at the same gradient as the voltage across the capacitor 180. When the voltage across the capacitor 180 goes below the threshold voltage Vth2 (t=t4), the comparator 117 has its output switched to the H-level, causing the sweep circuit 110 to provide a fixed voltage equal to the threshold voltage Vth2. That is, during the transition period (t3 to t4), the sweep circuit 110 has its output lowering at the constant gradient, thereby correspondingly lowering the second current I2 flowing through the resistor 122 of the inverter controller 100 shown in FIG. 3, and therefore lowering the switching frequency (f2 to f3) at the constant gradient, which is output from the inverter controller 100 to the driver.

Figure 6:
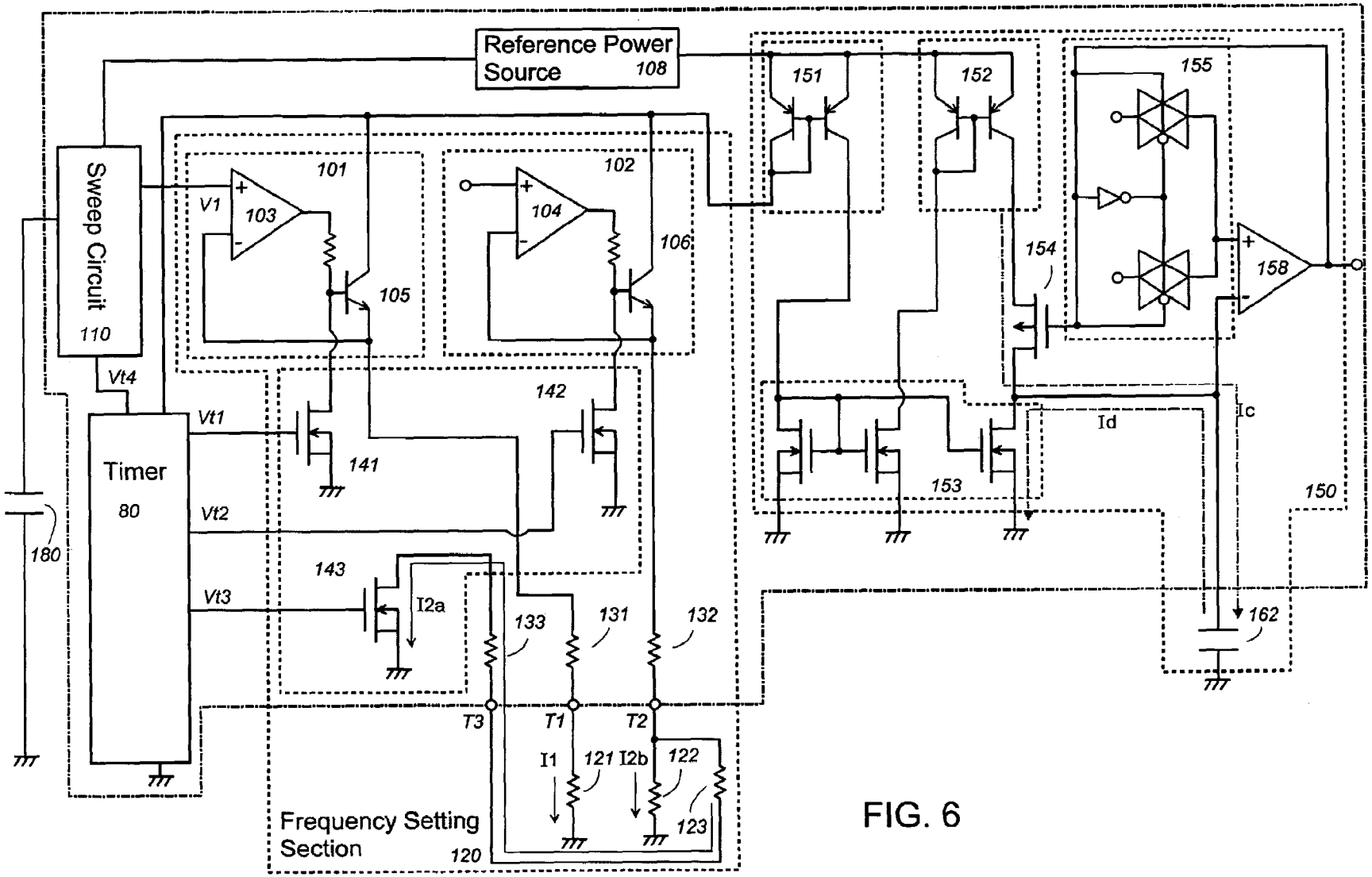
FIG. 6 is a circuit diagram of a first modification of the first embodiment.

FIG. 6 illustrates a first modification of the above first embodiment which is identical in configurations and functions to the first embodiment except for the connections of the third switching element 143 to the external resistors 121, 122, and 123 within the inverter controller 100. Therefore, the like parts are designated by the like reference numerals and no duplicate explanation is made here. In the modification, the connection of the terminal T2 of the integrated circuit to the external resistor 122 is connected through the external resistor 123 to the terminal T3 so that the series circuit of the third switching element 143, the external resistor 123, and the internal resistor 133 is connected in parallel with the external resistor 122 to establish the shunt path diverging from the second current path.

During the preheating period (t1 to t2), the first and second switching elements 141 and 142 are turned off, while the third switching element 143 is turned on so as to flow the first current I1 through the resistors 131 and 121 from the first current generation circuit 101, and at the same tie to flow the second current I2*a* through the shunt path (resistor 123 and third switching element 143), thereby flowing the summed current (I1+I2*a*) through the current mirror 152 to charge and discharge the capacitor 162 based upon the current for determination of the preheating frequency.

During the starting period (t2 to t3), the first and second switching elements 141 and 142 are turned off, while the third switching element 143 is also turned off so as to flow the first current I1 through the resistors 131 and 121 from the first current generation circuit 101, and at the same tie to flow the second current I2*b* through the external resistor 122, thereby flowing the summed current (I1+I2*b*) through the current mirror 152 to charge and discharge the capacitor 162 based upon the current for determination of the starting frequency.

During the transition period (t3 to t4), the sweep circuit 110 has its output voltage gradually lowering so that the sum (I1+I2*b*) of the first and second currents is correspondingly lowered to vary the switching frequency gradually from the starting frequency (f2) to the lighting frequency (f3).

During the lighting period (t4−), the first and third switching elements 141 and 143 are turned off, while the second switching element 143 is turned on so as to flow the first current I1 through the resistors 131 and 121 from the first current generation circuit 101, which current flows in the current mirror 152 to charge and discharge the capacitor 162 for determination of the lighting frequency.

Figure 7:
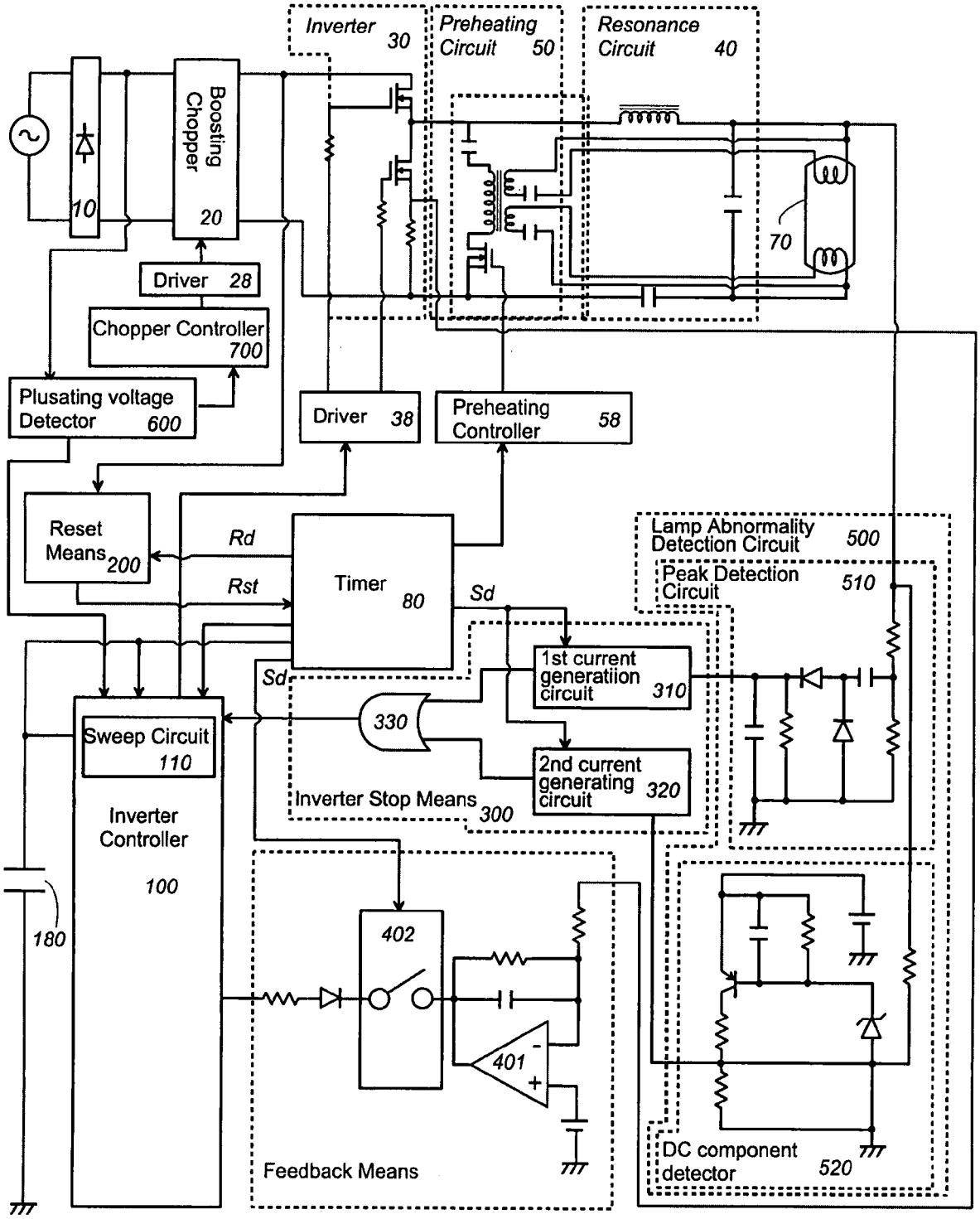
FIG. 7 is a circuit diagram of a second modification of the first embodiment.

FIG. 7 illustrates a second modification of the first embodiment which is identical to the first embodiment except that the capacitor 180 of the sweep circuit 110 is shared by the timer 80. Therefore, the like parts are designated by the like reference numerals and no duplicate explanation is made here. In the modification, the timer 80 is configured to utilize the charging and discharging of the capacitor 180 to determine the start timing (t2) and the end timing (t3) of the starting period.

Figure 8:
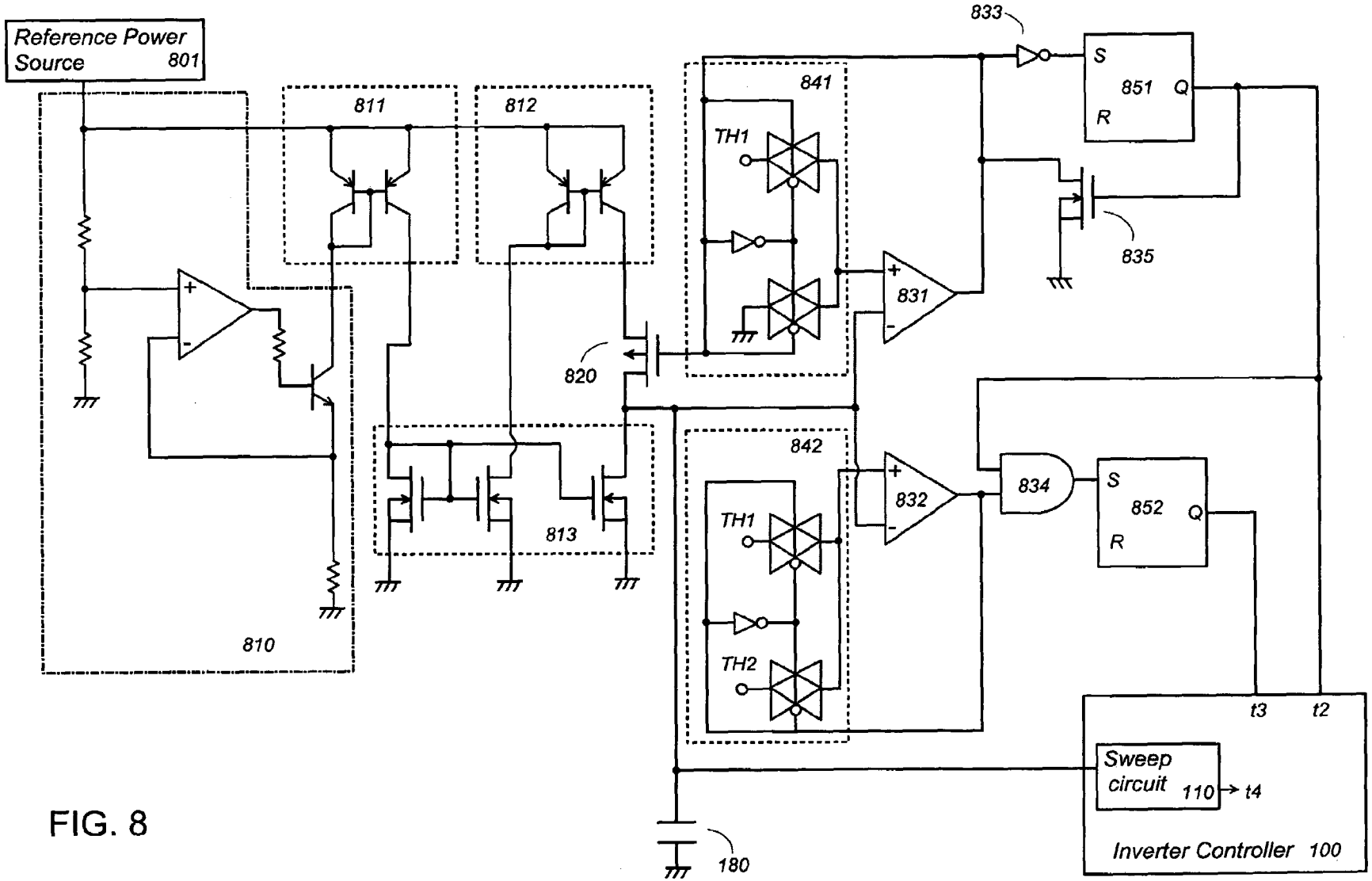
FIG. 8 is a circuit diagram of a timer utilized in the above device.

In this modification, the timer 80 includes, as shown in FIG. 8, a constant current circuit 810 flowing a constant current from a reference power source 801, current mirrors 811, 812, and 813 charging and discharging the capacitor 180 at a constant current, a switching element 820 switching the charging to and from discharging, a pair of comparators 831 and 832 comparing the voltage across the capacitor 180 with reference values, and flip-flops 851 and 852 providing signals respectively for determination of the start timing (t2) and the end timing (t3) of the starting period.

Each of the comparators 831 and 832 receives the voltage across of the capacitor 180 at its inverting input, while the first comparator 831 has its non-inverting input connected to a first reference value switching circuit 841 and the second comparator 832 has its non-inverting input connected to a second reference value switching circuit 842. The first reference value switching circuit 841 switches a reference value TH1 to and from a reference value TH0 in accordance with the output from the first comparator 831, while the second reference value switching circuit 842 switches the reference value TH1 to and from a reference value TH2. The relation between the reference values is set to be TH1>TH2>TH0. The output of the first comparator 831 is inverted at a NOT-gate 833 and is input to a set terminal S of the first flip-flop 851. The output of the second comparator 832 is given to one input of an AND-gate 843 which receives at its other input the output from the first flip-flop 851. The output of AND-date 834 is given to a set terminal S of the second flip-flop 852.

Figure 9:
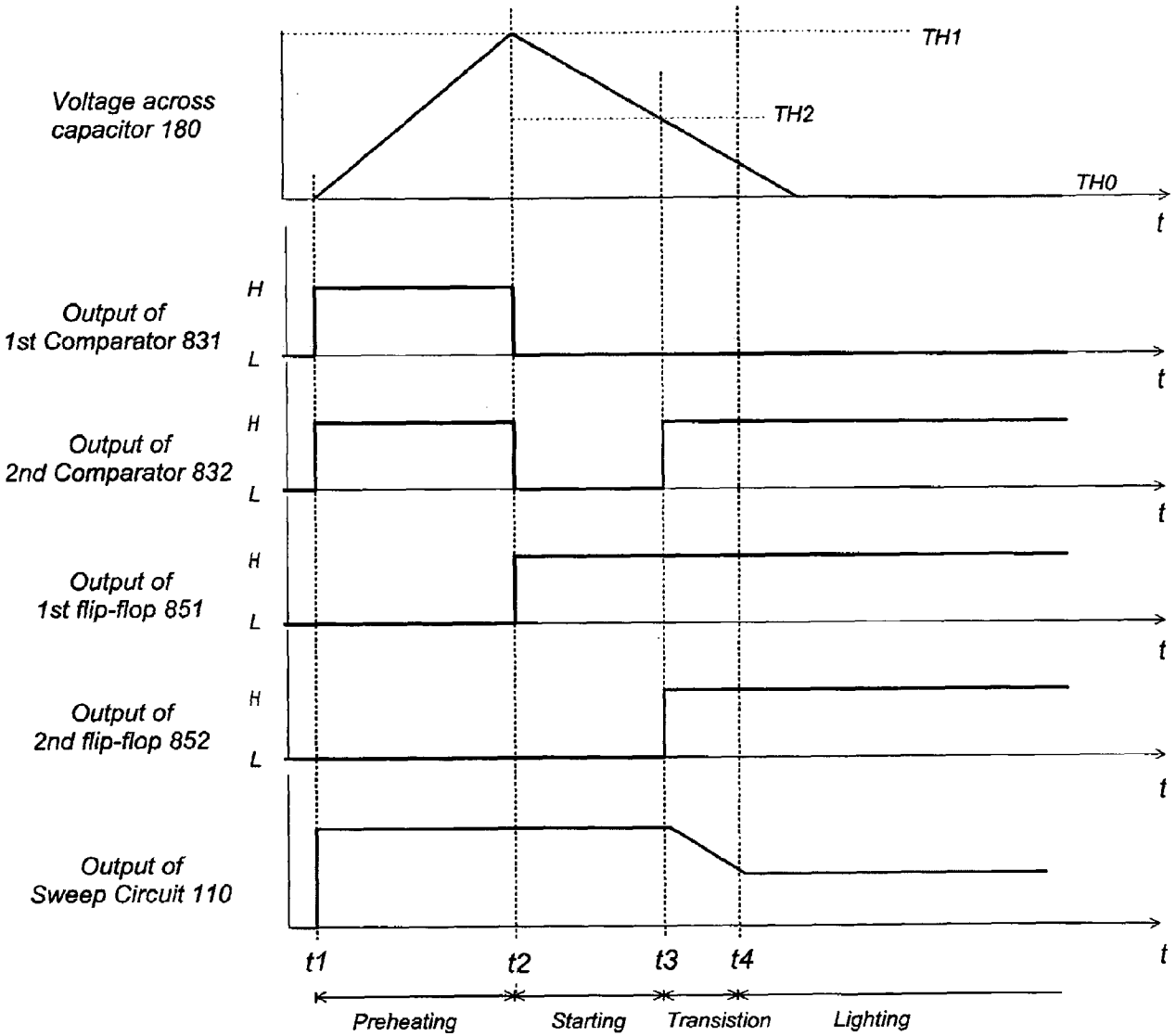
FIG. 9 is a waveform chart illustrating the operation of the above timer.

Operation of thus configured timer 80 is explained with reference to FIG. 9. Immediately after the timer being energized where the capacitor 180 is not charged, the first comparator 831 provides H-level output. Thus, the switching element 820 is turned on to charge the capacitor 180 by a constant current flowing through the current mirror 812. Until the capacitor 180 is charged up to reference value TH1, the first comparator 831 and the second comparator 832 provide respectively H-level outputs, keeping the first flip-flop 851 and the second flip-flop 852 to provide L-level outputs. Upon the voltage across the capacitor 180 reaching the reference value TH1, the first comparator 831 provides L-level output to turn off the switching element 820, which terminates the charging of the capacitor 180 and therefore starts discharging the capacitor 180 through the current mirror 813. At this occurrence, the first flip-flop 851 receives H-level signal at its set terminal S due to the L-level output from the first comparator 831, providing H-level signal which is fed to the inverter controller 100 as a signal determining the start timing (t2) of the starting period. The first and second reference value switching circuits 841 and 842 operate to switch the reference values from TH1 to TH0, and TH1 to TH2, respectively. Also at this occurrence, the switch 835 connected between the output of the first comparator 831 and the ground is turned on by H-level from the first flip-flop 851, forcing the first comparator 831 to provide L-level output and therefore turning off the switching element 820 to disable the subsequent charging of the capacitor 180.

As the capacitor 180 is discharged to lower its voltage below the reference value TH2, the second comparator 832 gives a H-level signal through the AND-date 834 to the set terminal S of the second flip-flop 852. Whereby the second flip-flop 852 provides a H-level output which is fed to the inverter controller 100 as determining the end timing (t3) of the starting period. The voltage across the capacitor 180 is fed to the sweep circuit 110 in the inverter controller 100 which recognizes the end timing (t4) of the transition period when the voltage is lowered to a predetermined value. In this connection, the inverter controller 100 recognizes the start timing (t1) of the preheating period when both of the first flip flop 851 and the second flip-flop 852 provide the L-level outputs.

Figure 10:
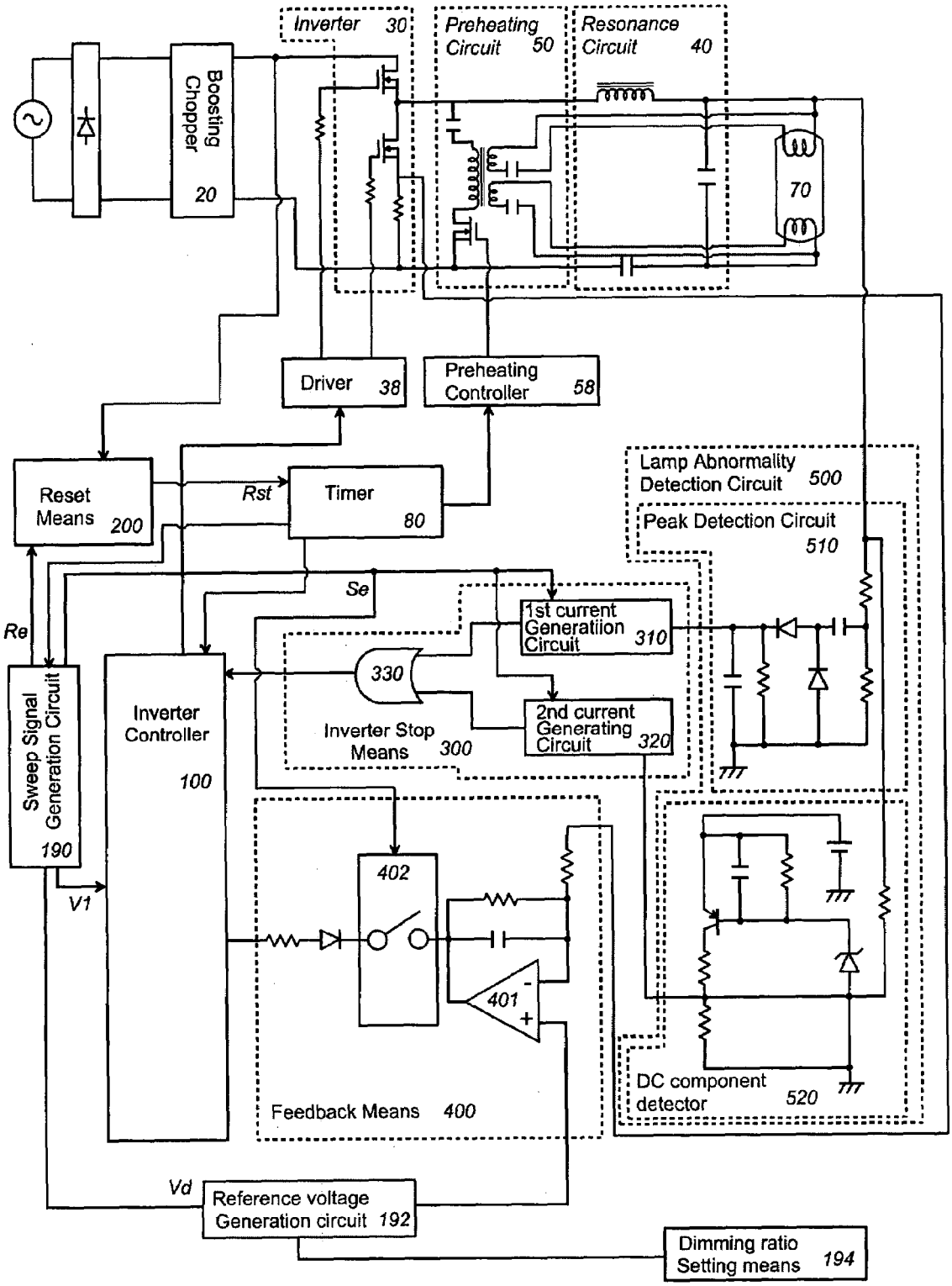
FIG. 10 is a block circuit diagram of a third modification of the first embodiment.

FIG. 10 illustrates a third modification of the above first embodiment which is identical to the first embodiment in configurations and functions except that a sweep signal generation circuit 190 is employed instead of the sweep circuit 110 using the capacitor 180 so as to give a like DC voltage V1 to the frequency setting section 120 (see FIG. 3) within the inverter controller 100, and that a dimming ratio input means 194 is employed to dim the discharge lamp. The like parts are designated by like reference numerals, and no duplicate explanation is made here.

Figure 11:
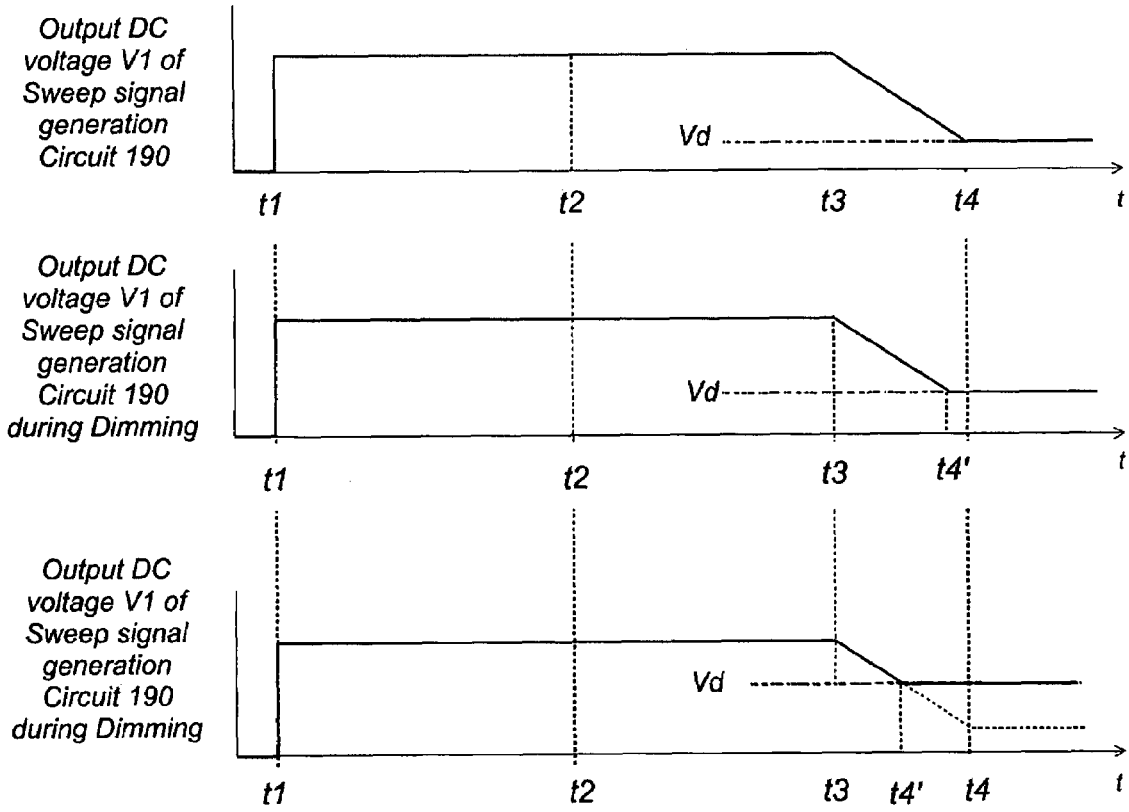
FIG. 11 is a waveform chart illustrating the operation of the modification of FIG. 10.

The sweep signal generation circuit 190 is configured to provide the DC voltage V1 which, as shown in FIG. 11, lowers from the end timing (t3) of the starting period, and to keep the DC voltage V1 at a reference value Vd once it reaches to the reference value determined by a reference voltage generation circuit 192. The reference value Vd varies with a dimming ratio of the discharge lamp selected at the dimming ratio input means 194. Accordingly, the start timing of the lighting period will shift from t4 to t4' in relation to the dimming ratio, as shown in FIG. 11. The reference value Vd is utilized as the reference voltage given to the comparator 401 of the feedback means 400 such that the current flowing through the inverter 30 is adjusted with the reference value to regulate the lamp current for dimming the discharge lamp. In this modification, the sweep signal generation circuit 190 manages the timing based upon the clock signal from the timer 80 so as to provide a trigger signal Se at the end timing (t3) of the starting period to the inverter stop means 300 and the feedback means 400 for enabling these means, and a trigger signal Re at the end timing (t4) of the transition period to the reset means 200 fro enabling the same. The inverter stop means 300, the feedback means 400, and the reset means 200 are all disabled until receiving these enabling signals.

Second Embodiment

Figure 12:
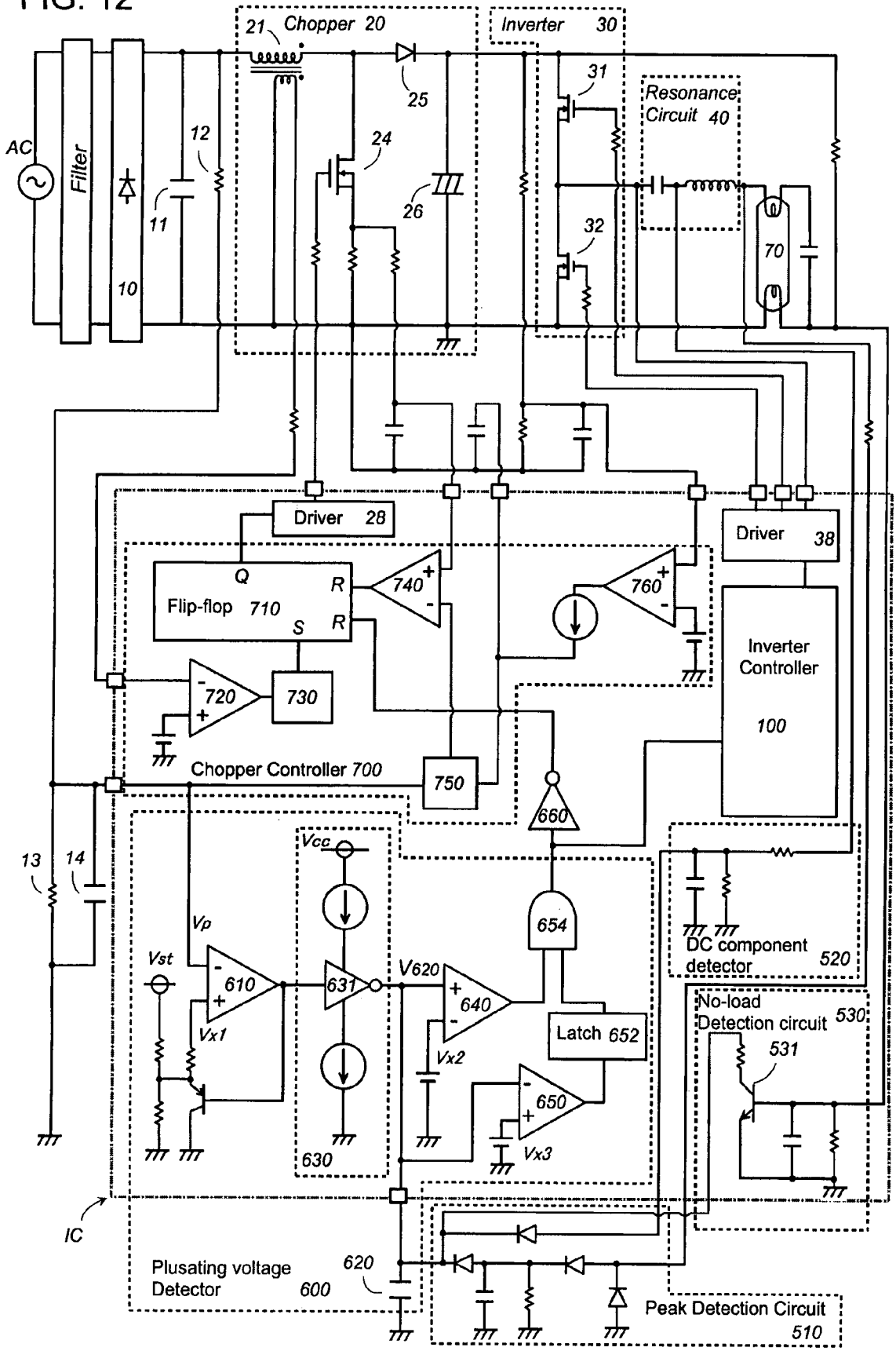
FIG. 12 is a block circuit diagram illustrating a discharge lamp ballast device in accordance with a second embodiment of the present invention.

FIG. 12 illustrates a discharge lamp ballast device in accordance with a second embodiment of the present invention. The discharge lamp ballast device is basically identical in configurations and functions to the first embodiment, but includes a pulsating voltage detection circuit 600 which stops the inverter 30 and the chopper 20 when a pulsating DC voltage Vp from the rectifier 10 to the chopper goes below a predetermined value. The like parts are designated by like reference numerals, and no duplication explanation is made herein.

The rectifier 10 provides the pulsating DC voltage to the chopper 20 through a filtering capacitor 11. The chopper 20 includes a switching element 24 connected in series with an inductor 21 across the output ends of the rectifier 10, and a smoothing capacitor 26 connected in series with a diode 25 across the switching element 24. The switching element 24 is controlled by the chopper controller 700 to turn on and off, accumulating a smoothed DC voltage in the smoothing capacitor 26 which is output to the inverter 30.

Figure 13:
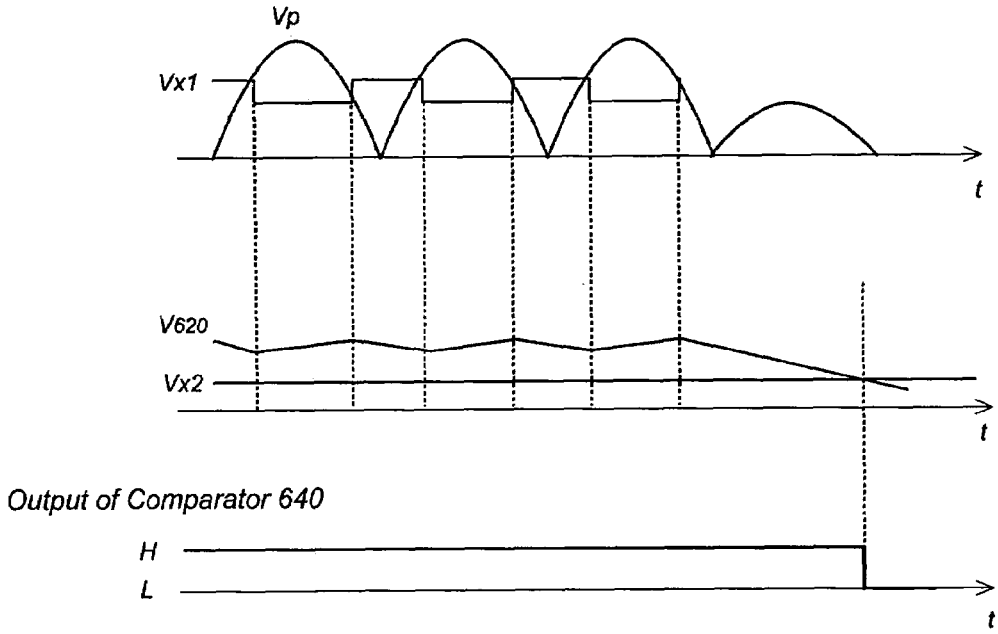
FIG. 13 is a waveform chart illustrating the operation of the above discharge lamp ballast device.

The pulsating DC voltage from the rectifier 10 is input as voltage Vp to the pulsating voltage detection circuit 600 through resistors 12 and 13, and a capacitor 14, and is compared with a predetermined threshold such that, when the level of the pulsating DC voltage is lower than the threshold, the pulsating voltage generation circuit 600 provides a stop signal to the inverter controller 100 and the chopper controller 700 for stopping the inverter 30 and the chopper 20. The pulsating voltage detection circuit 600 includes a comparator 610 comparing the voltage Vp with a first threshold Vx1, a constant current circuit 630 charging and discharging a capacitor 620 at a constant current in accordance with the output of the comparator 610, and a comparator 640 comparing a voltage across capacitor 620 with a second threshold Vx2. The output of the comparator 610 is inverted at a NOT-gate 631 so that the capacitor 620 is charged by the constant current given from the constant current circuit 30 when the voltage Vp exceeds the threshold Vx1, while the capacitor 620 is discharged at the constant current drawn into the constant current circuit 30 when the voltage Vp is lowered below the first threshold Vx1. As shown in FIG. 13, the first threshold Vx1 varies into two levels according to the output of the comparator 610 to thereby give a hysteresis. The first threshold Vx from the switching circuit composed of resistors and a switch is input to a non-inverting input of the comparator 610. The constant current circuit 630 is set to give a charging current to the capacitor 620 greater than the discharging current.

The capacitor 620 thus repeating to be charged and discharged based upon the pulsating DC voltage has its voltage V620 compared at the comparator 640 with the second threshold Vx2 such that the comparator 640 provides a H-level signal to the inverter controller 100 when voltage V620 exceeds the second threshold Vx2, i.e. the output voltage from the rectifier 10 to the chopper 20 is judged to be sufficient, thereby enabling the inverter 30. The H-level signal is inverted at NOT-gate 660 to give a L-level signal to a reset terminal R of a flip-flop 710 of the chopper controller 700 which responds to continue operating the chopper 20. As shown in FIG. 13, when voltage V620 across the capacitor 620 goes below the second threshold Vx2, i.e. the output from the rectifier 10 is lowered, the comparator 640 provides a L-level signal to the inverter controller 100 which responds to stop the inverter 30. Concurrently, the output from the comparator 640 is inverted at NOT-gate 660 into a H-level signal which is fed to a reset terminal of the flip-flop 710, thereby stopping the chopper 20.

The flip-flop 710 of the chopper controller 700 is configured to provide a driving signal to the driver 28 for turning on and off the switching element 24 of the chopper 20, while the chopper controller 700 includes, in addition to the flip-flop 710, a comparator 720 judging whether or not the inductor 21 sees a current, a one-shot trigger 730, and a comparator 740 determining on-period of the switching element 24 of the chopper 20. When the inductor 21 sees the current, i.e. the switching element 24 is off, the one-shot trigger 730 responds to the output from the comparator 720 for providing a H-level signal to the set terminal S of the flip-flop 710, thereby turning on the switching element 24 and flowing the current through the switching element 24. When the current exceeds a predetermined value, the comparator 740 provides a H-level signal to the reset terminal R of the flip-flop to thereby turn off the switching element 24. By repeating the above operations, the chopper 20 generates the output voltage.

The comparator 740 receives at its non-inverting input a voltage corresponding to the current flowing through the switching element 24 so as to compare the voltage with a threshold given to its inverting input, thus determining the on-time of the switching element 24 by the threshold. The threshold is defined by an output from a multiplier 750, and is created by a pulsating DC voltage output from the rectifier 10 and the output voltage of the chopper 20. That is, the multiplier 740 receives the voltage Vp given to the pulsating voltage detection circuit 600 and a voltage given from an error-amplifier 760 indicative of the output voltage from the chopper 20 so that, when the current through the switching element 24 exceeds the threshold determined by the multiplier 750, the flip-flop 10 receives H-level signal at its reset terminal R to turn off the switching element 24. With such on-off control, the chopper 20 provides a constant DC output Vc at a high power factor.

The pulsating voltage detection circuit 600 is additionally provided with a comparator 650 for comparison of voltage V620 across the capacitor 620 with a third threshold Vx3, a latch 652 holding the output of the comparator 650, and an AND-gate 654 receiving the outputs from the latch 652 and the previously mentioned comparator 640. The third threshold Vx3 is set to be higher than the voltage Vp corresponding to the pulsating DC voltage at a normal operating condition, which normally causes the latch 652 to provide the H-level output and therefore allow the output from the comparator 640 to pass through the AND-gate 654. Accordingly, the enabling and disabling the inverter 30 and the chopper 20 is based upon the comparison between the second threshold Vx2 and the voltage of the capacitor 620.

The present embodiment includes the peak detection circuit 510 and the DC component detection circuit 520 for detection of the lamp's life end as in the first embodiment. These circuits are configured to charge the capacitor 620 of the pulsating voltage detection circuit 620 by the peak value and the DC component of the lamp current of the discharge lamp. Consequently, upon connection of the discharge lamp coming to the life-end, at least one of the peak value and the DC component goes high so that the charged voltage of the capacitor 620 exceeds the third threshold Vx3. Upon this occurrence, the comparator 650 provides a L-level signal while the AND gate 654 provides L-level signal so that the inverter controller 100 is given a stop signal for stopping the inverter 30, and at the same time the chopper controller 700 is give a stop signal for stopping the chopper 20. Thus, the inverter 30 and the chopper 20 are stopped to avoid excessive stress from acting on the circuit components of the individual circuits.

Further, the present embodiment is provided with a no-load detection circuit 530 which is configured to stop the inverter 30 and the chopper 20 when the discharge lamp is out of connection. The no-load detection circuit 530 includes a switch 531 which is connected in parallel with the capacitor 620 and is caused to turn on when the series circuit of the switching elements 31 and 32 in the inverter 30 gives the voltage exceeding a predetermined voltage. Upon no-load detection, the capacitor 620 is discharged through the switch 531. With this result, the voltage V620 of the capacitor 620 lowers below the second threshold Vx2, such that the comparator 640 provides the L-level signal as in the case where the pulsating DC voltage is lowered, thereby stopping the inverter 30 and the chopper 20 and therefore avoiding excessive stress from acting on the circuit components.

As discussed in the above, since the pulsating voltage detection circuit 600, the life-end detection circuits 510 and 520, and the no-load detection circuit 530 share the capacitor 620, the present embodiment can reduce the number of components while assuring multi-functions. Further, as indicated by dotted lines IC in FIG. 12, the pulsating voltage detection circuit 600 other than the capacitor 620 is integrated into an integrated circuit together with the inverter controller 100, the chopper controller 700, as well as the drivers 28 and 38.

The invention claimed is:

1. A discharge lamp ballast device comprising:

a rectifier configured to rectify an AC voltage from an AC power supply;

a chopper configured to include an inductor, a smoothing capacitor, and a switching element to convert an output voltage from the rectifier into a DC voltage;

an inverter configured to include at least one switching element and turn on and off said switching element at a high frequency for converting an output of the chopper into an AC power;

a resonance circuit configured to include at least one inductor and a capacitor to resonate the AC power output from said inverter to apply the same to a discharge lamp;

an inverter controller configured to selectively drive said at least one switching element at one of a preheating frequency, a starting frequency, and lighting frequency which are different from each other, to give a preheating mode in which the inverter provides a preheating voltage for preheating filaments of said discharge lamp, a starting mode in which the inverter provides a starting voltage for staring the discharge lamp, and a lighting mode in which the inverter provides a lighting voltage for stably lighting said discharge lamp;

a lamp abnormality detection circuit configured to detect abnormality of said discharge lamp;

reset means configured to the output voltage supplied from said chopper to said inverter, and to cause said inverter controller to operate at said starting mode or preheating mode when the output voltage from said chopper is lowered below a first threshold;

inverter stop means configured to operate said inverter controller to stop said inverter when said lamp abnormality detection circuit detects the abnormality; and a timer configured to provide to said inverter controller a signal determining the start of said preheating mode, said starting mode, and said lighting mode, and to generate a reset disable signal Rdis disabling said reset means and a inverter stop disable signal Sdis disabling said inverter stop means, respectively;

wherein said inverter controller includes a frequency sweep means which varies the switching frequency gradually from said starting frequency to said lighting frequency, said timer is configured to generate said reset disable signal only during a period (t1 to t4) starting upon selection of said preheating frequency and ending at a time when said switching frequency is caused by said frequency sweep means to reach said lighting frequency, thereby disabling said reset means during said period;

said timer is configured to generate said inverter stop disabling signal only during a period (t1 to t3) starting upon selection of said preheating frequency and ending at a time when said switching frequency is caused by said frequency sweep means to begin varying from the starting frequency to said lighting frequency, thereby disabling said inverter stop means during this period.

2. A ballast as set forth in claim 1, further including:

a feedback means configured to detect a current flowing through said at least one switching element constituting said inverter and to control said inverter controller to keep said current at a predetermined value;

said timer is configured to disable said feedback means only during a period (t1 to t3) starting upon selection of said preheating frequency and ending at the time when said switching frequency is caused by said frequency sweep means to begin varying towards said lighting frequency.

3. A discharge lamp ballast device as set forth in claim 1, further including:

a preheating circuit configured to supply a preheating current to the filaments of said discharge lamp; and a preheating controller configured to control said preheating circuit for regulation of said preheating current, said preheating controller, upon reception of a signal from said timer, controlling said preheating circuit to supply the preheating current during a period ranging from the preheating mode to the end of said staring mode, and to restrain the preheating current after the end of said staring mode.

4. A discharge lamp ballast device as set forth in claim 1, wherein said lamp abnormality detection circuit is configured to detect a physical amount indicative of a condition of said discharge lamp, said inverter stop means is configured to include a signal generation circuit which provides a stop signal when said physical amount exceeds a predetermined reference, said inverter controller stops the output of said inverter in response to said stop signal, said signal generation circuit is configured to define said reference by a first lamp threshold or a second lamp threshold greater than said first lamp threshold, said signal generation circuit is configured to select said second lamp threshold during a transition period in which the switching frequency varies from said starting frequency to the lighting frequency, and otherwise select said first lamp threshold.

5. A discharge lamp ballast device as set forth in claim 4, wherein said inverter stop means is configured to detect the abnormality of the discharge lamp based upon a peak value of the voltage across the discharge lamp and a DC component included in the voltage across the discharge lamp.

6. A discharge lamp ballast device as set forth in claim 5, wherein said lamp abnormality detection circuit comprises a peak detection circuit for detection of the peak value of the voltage across the discharge lamp, and a DC component detection circuit for detection of the DC component included in the voltage across the discharge lamp, said inverter stop means comprises a first signal generation circuit generating a first stop signal when said peak value exceeds a predetermined threshold, and a second signal generation circuit generating a second stop signal when said DC component exceeds a predetermined threshold so as to provide a stop signal to said inverter controller for lowering the output of the inverter upon receiving any one of said first and second stop signals, at least one of said first and second signal generation circuits has a first threshold and a second threshold greater than said first threshold, and selects said second threshold during the transition period (t3 to t4) where the switching frequency varies from said starting frequency to said lighting frequency, and otherwise selects said first threshold.

7. A discharge lamp ballast device as set forth in claim 1, wherein said inverter controller, said reset means, and said inverter stop means are realized in a single integrated circuit, said inverter controller comprises a frequency setting section which gives said switching frequencies respectively corresponding to said individual said modes in response to the output signal from said timer, and said frequency sweep means is configured to sweep the frequency set at said frequency setting section in accordance with a varying charged or discharged voltage across a capacitor externally connected to said integrated circuit.

8. A discharge lamp ballast device as set forth in claim 1, wherein said inverter controller, said reset means, and said inverter stop means are realized in a single integrated circuit, said inverter controller comprises a frequency setting section which sets said switching frequency at a frequency in match with said modes according to the output signal from said timer, said timer comprises a circuit which charges and discharges a capacitor externally connected to said integrated circuit for determining the end of the preheating mode and the end of the starting mode by a charged voltage of said capacitor, and said frequency sweep means is configured to sweep the frequency set at the frequency setting section in accordance with a varying charged or discharged voltage of said capacitor in order to determine the start of the lighting mode.

9. A discharge lamp ballast device as set forth in claim 1, wherein said inverter controller, said reset means, and said inverter stop means are realized in a single integrated circuit, said inverter controller comprises a frequency setting section which sets said switching frequency at a frequency in match with said modes according to the output signal from said timer, said timer comprises a circuit which charges and discharges a capacitor externally connected to said integrated circuit for determining the end of the preheating mode when the charged voltage of the capacitor increases up to a first predetermined value, and determining the end of the starting mode when the discharged voltage of the capacitor lowers down to a second predetermined value, and said frequency sweep means is configured to sweep the frequency given by the frequency setting section from said starting frequency to said lighting frequency in accordance with a discharged voltage of the capacitor lowering beyond the second threshold.

10. A discharge lamp ballast device as set forth in claim 1, wherein said inverter controller, said reset means, and said inverter stop means are realized in a single integrated circuit, said inverter controller comprises a frequency setting section which sets said switching frequency at a frequency in match with said modes according to the output signal from said timer, and said frequency sweep means comprises a sweep signal generation circuit which provides a DC voltage lowering immediately after the end of the starting mode according to the output signal of said timer, whereby said frequency setting section varies the switching frequency according to the varying DC voltage.

11. A discharge lamp ballast device as set forth in claim 10, wherein said sweep signal generation circuit is configured to provides a first trigger signal for disabling and enabling said reset means, and a second trigger signal for disabling and enabling said inverter stop means.

12. A discharge lamp ballast device as set forth in claim 1, wherein said inverter controller is configured to vary a high frequency power output from said inverter in accordance with an external demand of dimming ratio during said lighting mode, and said frequency sweep means is configured to vary a sweep duration based upon said dimming ratio.

13. A discharge lamp ballast device as set forth in claim 1, wherein said frequency sweep means is configured to provide a sweep voltage varying gradually during a transition period from the end of said starting period to the start of the lighting period, said inverter controller comprises:

a first current generation circuit providing a first output current in proportion to said sweep voltage;

a second current generation circuit providing a second output current of a constant level;

a drive signal generation circuit which is equipped with a capacitor being charged and discharged by the first and second output currents to determine the switching frequency based upon a charging-and-discharging rate of said capacitor; and a switching circuit which actuates said first and second current generation circuits selectively or simultaneously, said switching circuit is controlled by said timer to actuate the first current generation circuit and said second current generation circuit during the preheating mode for determining the preheating frequency based upon the sum of the first current and the second current, to actuate only the first current generation circuit during the starting mode for determining the starting frequency based upon the first current, to actuate only the first current generation circuit during the transition period for varying the switching frequency gradually to the lighting frequency in accordance with the sweep voltage, and to actuate only the second current generation circuit for determining the switching frequency based upon the second current.

14. A discharge lamp ballast device as set forth in claim 13, wherein said first current generation circuit includes a first impedance element, said second current generation circuit includes a second impedance element, and said switching circuit includes a first switching element which interrupts the first current flowing through said first impedance element, and a second switching element which interrupts the second current flowing through said second impedance element.

15. A ballast as set forth in claim 14, wherein said first impedance element comprises at least one first resistor inserted in a first current path between a current source of said first current generation circuit and a ground, said second impedance element comprises at least one second resistor inserted in a second current path between a current source of said second current generation circuit and a ground, said switching circuit comprises a third switching element inserted in a shunt path diverted from the first current path, said third switching element is controlled by said timer to flow the first current through said first current path during one of the preheating mode and the starting mode, and to flow the first current through said shunt path during the other mode.

16. A discharge lamp ballast device as set forth in claim 15, wherein said inverter controller is formed into an integrated circuit except for the first and second resistors, said first resistor is connected between a first terminal of the integrated circuit and said ground, said second resistor is connected between a second terminal of the integrated circuit and said ground, said third switching element included in said integrated circuit is inserted between a third terminal of the integrated circuit and the ground, and said third terminal is connected between the first resistor and the first terminal.

17. A discharge lamp ballast device as set forth in claim 15, wherein said first impedance element comprises at least one first resistor inserted in the first current path between the current source of said first current generation circuit and the ground, said second impedance element comprises at least one second resistor inserted in the second current path between the current source of said second current generation circuit and the ground, said switching circuit includes the third switching element inserted in series with a third resistor in a shunt path diverted from the second current path, said third switching element is controlled by said timer to flow the second current through the second current path during one of said preheating mode and said starting mode, and to flow the second current through the shunt path in the other mode.

18. A discharge lamp ballast device as set forth in claim 17, wherein said inverter controller is formed into an integrated circuit except for the first and second resistors, said first resistor is connected between a first terminal of the integrated circuit and said ground, said second resistor is connected between a second terminal of the integrated circuit and said ground, the third switching element included in said integrated circuit is inserted between a third terminal of the integrated circuit and the ground, and said third terminal is connected between the second resistor and the second terminal.

19. A discharge lamp ballast device as set forth in claim 1, further including:

a pulsating voltage detection circuit configured to detect the output voltage from the rectifier to the chopper and to provide a signal to said inverter controller for stopping the inverter upon lowering of the output voltage, said pulsating voltage detection circuit comprising:

a comparator which compares a pulsating DC voltage output from said rectifier to said chopper with a predetermined voltage;

a capacitor which is charged and discharged depending upon an output of the comparator;

a constant current circuit configured to charge and discharge the capacitor at a constant current; and a discriminator configured to compare the voltage across the capacitor with a predetermined reference, said constant current circuit configured to charge the capacitor at the constant current from the constant current circuit when receiving from the comparator an output indicative of that said pulsating DC voltage exceeds said predetermined voltage, and otherwise discharge the capacitor to provide the constant current from said capacitor to said constant current circuit, said discriminator is configured to provide to said inverter controller an enable signal of enabling the inverter to operate, and otherwise provide a disable signal to said inverter controller for stopping the operation of the inverter.

20. A discharge lamp ballast device as set forth in claim 19, further including a no-load detection circuit for judging a load connected condition of the inverter, said no-load detection circuit being configured to discharge said capacitor upon no-load detection.

21. A discharge lamp ballast device as set forth in claim 19, further including a chopper controller for control the output of said chopper, said chopper controller being configured to control said chopper based upon an input of the pulsating DC voltage and an output current from said chopper.

22. A discharge lamp ballast device as set forth in claim 19, wherein said constant current circuit is configured to make the charging current to said capacitor greater than the discharging current from said capacitor.

23. A discharge lamp ballast device as set forth in claim 19, further including:

a life-end detection circuit for deciding a life-end condition of said discharge lamp, said life-end detection circuit being configured to charge said capacitor by the output voltage of said inverter.

24. A discharge lamp ballast device as set forth in claim 23, wherein said life-end detection circuit includes a life detection circuit which is configured to detect a DC voltage component applied to the discharge lamp and judge the lamp life based upon the DC voltage component.

25. A discharge lamp ballast device as set forth in claim 23, wherein said life-end detection circuit includes a life detection circuit which is configured to detect a high frequency voltage applied to the discharge lamp and judge the lamp life based upon the high frequency voltage.

26. A discharge lamp ballast device as set forth in claim 19, wherein said pulsating voltage detection circuit has a hysteresis.

27. A lighting appliance equipped with a discharge lamp ballast device according to claim 1.

* * * * *